US012529301B2

(12) United States Patent
Donovan et al.

(10) Patent No.: US 12,529,301 B2
(45) Date of Patent: Jan. 20, 2026

(54) POWERED ORIENTATION OF DOWNHOLE SEPARATORS IN A WELL

(71) Applicant: Halliburton Energy Services, Inc., Houston, TX (US)

(72) Inventors: Stacey Blaine Donovan, Carrollton, TX (US); David J. Steele, Carrollton, TX (US); Christian Alexander Ramirez, Carrollton, TX (US)

(73) Assignee: Halliburton Energy Services, Inc., Houston, TX (US)

( * ) Notice: Subject to any disclaimer, the term of this patent is extended or adjusted under 35 U.S.C. 154(b) by 0 days.

(21) Appl. No.: 18/646,388

(22) Filed: Apr. 25, 2024

(65) Prior Publication Data

US 2025/0109674 A1 Apr. 3, 2025

Related U.S. Application Data

(60) Provisional application No. 63/586,096, filed on Sep. 28, 2023.

(51) Int. Cl.

| | |
|---|---|
| ***E21B 43/38*** | (2006.01) |
| ***E21B 43/12*** | (2006.01) |
| ***E21B 47/024*** | (2006.01) |

(52) U.S. Cl.
CPC ..... *E21B 43/38* (2013.01); *E21B 47/024* (2013.01); *E21B 43/128* (2013.01)

(58) Field of Classification Search
CPC ..... E21B 43/38; E21B 43/128; E21B 47/024
See application file for complete search history.

(56) References Cited

U.S. PATENT DOCUMENTS

| | | | | |
|---|---|---|---|---|
| 4,771,830 | A | 9/1988 | Peate | |
| 5,107,927 | A | 4/1992 | Whiteley et al. | |
| 5,165,450 | A | 11/1992 | Marrelli et al. | |
| 5,295,537 | A | 3/1994 | Trainer | |
| 5,314,018 | A | 5/1994 | Cobb | |
| 5,564,509 | A | 10/1996 | Dietzen | |
| 5,597,042 | A * | 1/1997 | Tubel | E21B 43/12 166/250.15 |
| 5,613,242 | A | 3/1997 | Oddo | |

(Continued)

FOREIGN PATENT DOCUMENTS

| | | |
|---|---|---|
| CN | 102235162 | 11/2011 |
| CN | 112240194 | 1/2021 |

(Continued)

OTHER PUBLICATIONS

"PCT Application No. PCT/US2024/026360 International Search Report and Written Opinion", Aug. 19, 2024, 13 pages.

(Continued)

*Primary Examiner* — Dany E Akakpo
(74) *Attorney, Agent, or Firm* — DeLizio, Peacock, Lewin & Guerra LLP

(57) ABSTRACT

In some implementations, a downhole oil-water separation (DOWS) assembly may be configured to be disposed downhole in a well. The DOWS assembly may include a DOWS device configured to operate on fluids in the DOWS assembly. The DOWS assembly also may include a controller configured to determine an orientation of the DOWS device and to cause a change to the orientation of the DOWS device.

22 Claims, 23 Drawing Sheets

(56) References Cited

U.S. PATENT DOCUMENTS

| | | | |
|---|---|---|---|
| 5,673,752 | A | 10/1997 | Scudder et al. |
| 5,690,708 | A | 11/1997 | Danckaarts et al. |
| 5,711,374 | A | 1/1998 | Kjos |
| 5,762,149 | A | 6/1998 | Donovan et al. |
| 5,837,152 | A | 11/1998 | Komistek |
| 5,996,690 | A | 12/1999 | Shaw et al. |
| 6,082,452 | A | 7/2000 | Shaw et al. |
| 6,089,317 | A | 7/2000 | Shaw |
| 6,092,599 | A | 7/2000 | Berry et al. |
| 6,131,660 | A | 10/2000 | Stuebinger et al. |
| 6,170,580 | B1 | 1/2001 | Reddoch |
| 6,179,071 | B1 | 1/2001 | Dietzen |
| 6,189,613 | B1 | 2/2001 | Chachula et al. |
| 6,213,208 | B1 | 4/2001 | Skilbeck |
| 6,277,286 | B1 | 8/2001 | Sontvedt et al. |
| 6,336,504 | B1 | 1/2002 | Alhanati et al. |
| 6,378,608 | B1 | 4/2002 | Nilsen et al. |
| 6,394,183 | B1 | 5/2002 | Schrenkel et al. |
| 6,719,048 | B1 * | 4/2004 | Ramos ..... E21B 43/38 166/250.15 |
| 6,755,978 | B2 | 6/2004 | Oddie et al. |
| 7,017,663 | B2 | 3/2006 | Polderman et al. |
| 7,971,657 | B2 | 7/2011 | Hollier et al. |
| 8,286,805 | B2 | 10/2012 | Hopper |
| 8,505,627 | B2 | 8/2013 | Cox |
| 8,950,510 | B2 | 2/2015 | Bender |
| 9,289,700 | B2 | 3/2016 | Andreussi et al. |
| 9,334,699 | B2 | 5/2016 | Bender et al. |
| 9,359,878 | B2 | 6/2016 | Whitney et al. |
| 9,441,435 | B2 | 9/2016 | Leitch |
| 10,323,494 | B2 | 6/2019 | Joshi et al. |
| 10,344,570 | B2 | 7/2019 | Steele et al. |
| 10,583,373 | B2 | 3/2020 | Braaten et al. |
| 10,626,682 | B2 | 4/2020 | Hope et al. |
| 10,767,477 | B1 | 9/2020 | Leeper et al. |
| 10,844,699 | B2 | 11/2020 | Xiao et al. |
| 11,008,848 | B1 | 5/2021 | Webber et al. |
| 11,103,807 | B2 | 8/2021 | Oneto et al. |
| 11,143,009 | B1 | 10/2021 | Novak et al. |
| 11,173,427 | B2 | 11/2021 | Bayati et al. |
| 11,180,396 | B2 | 11/2021 | Andreussi et al. |
| 11,285,405 | B2 | 3/2022 | Johnson |
| 11,643,916 | B2 | 5/2023 | Gonzales et al. |
| 11,668,166 | B2 | 6/2023 | Lopez De Cardenas et al. |
| 11,708,746 | B1 | 7/2023 | Xiao et al. |
| 11,828,153 | B2 | 11/2023 | Moraes et al. |
| 11,913,322 | B1 | 2/2024 | Aleid et al. |
| 12,006,816 | B2 | 6/2024 | Al-Dhafeeri et al. |
| 12,305,498 | B2 | 5/2025 | Fripp et al. |
| 2002/0059866 | A1 | 5/2002 | Grant et al. |
| 2002/0153326 | A1 | 10/2002 | Oddie |
| 2003/0098799 | A1 | 5/2003 | Zimmerman |
| 2003/0205522 | A1 | 11/2003 | Polderman et al. |
| 2004/0118565 | A1 | 6/2004 | Crawford |
| 2006/0037746 | A1 | 2/2006 | Wright et al. |
| 2009/0242490 | A1 | 10/2009 | Hopper |
| 2010/0300684 | A1 | 12/2010 | Kotsonis et al. |
| 2011/0000675 | A1 | 1/2011 | Hackworth et al. |
| 2011/0079388 | A1 | 4/2011 | Cox |
| 2012/0006543 | A1 | 1/2012 | Cox et al. |
| 2012/0043088 | A1 | 2/2012 | Mcallister et al. |
| 2012/0080186 | A1 | 4/2012 | Reed |
| 2012/0285680 | A1 * | 11/2012 | Kumar ..... E21B 49/08 166/264 |
| 2013/0112598 | A1 | 5/2013 | Culver |
| 2013/0292327 | A1 | 11/2013 | Andreussi et al. |
| 2013/0312955 | A1 | 11/2013 | Medoff |
| 2013/0313200 | A1 | 11/2013 | Andreussi et al. |
| 2014/0014358 | A1 | 1/2014 | Leitch |
| 2014/0332391 | A1 | 11/2014 | Munisteri |
| 2015/0075772 | A1 | 3/2015 | Saponja et al. |
| 2015/0152715 | A1 | 6/2015 | Cunningham et al. |
| 2015/0306520 | A1 | 10/2015 | Grave et al. |
| 2015/0345264 | A1 | 12/2015 | Johnson |
| 2016/0047176 | A1 | 2/2016 | Martin |
| 2017/0009557 | A1 | 1/2017 | Harman et al. |
| 2017/0022797 | A1 | 1/2017 | Joshi et al. |
| 2017/0058659 | A1 | 3/2017 | El-Bakry et al. |
| 2017/0174530 | A1 | 6/2017 | Yin et al. |
| 2017/0234113 | A1 | 8/2017 | Steele |
| 2018/0002995 | A1 | 1/2018 | Dotson et al. |
| 2018/0051533 | A1 | 2/2018 | Zbranek et al. |
| 2018/0100383 | A1 | 4/2018 | Saponja et al. |
| 2018/0223642 | A1 | 8/2018 | Zahran |
| 2018/0320500 | A1 | 11/2018 | Williams |
| 2019/0032465 | A1 | 1/2019 | Ayub |
| 2019/0145220 | A1 | 5/2019 | Patel et al. |
| 2019/0186222 | A1 | 6/2019 | Steele et al. |
| 2019/0203575 | A1 | 7/2019 | Schlosser |
| 2019/0323331 | A1 | 10/2019 | Zahran |
| 2020/0123888 | A1 | 4/2020 | Saponja et al. |
| 2020/0215459 | A1 | 7/2020 | Oneto et al. |
| 2020/0217187 | A1 | 7/2020 | Wang et al. |
| 2020/0378235 | A1 | 12/2020 | Gonzales et al. |
| 2021/0055146 | A1 | 2/2021 | Bukhamseen et al. |
| 2021/0115771 | A1 | 4/2021 | Berntsen et al. |
| 2021/0140297 | A1 | 5/2021 | Webber et al. |
| 2021/0363836 | A1 | 11/2021 | Jandhyala et al. |
| 2021/0379511 | A1 | 12/2021 | Scott et al. |
| 2022/0034178 | A1 | 2/2022 | Hughes |
| 2022/0049581 | A1 | 2/2022 | Provost et al. |
| 2022/0056799 | A1 | 2/2022 | Johnson et al. |
| 2022/0220838 | A1 | 7/2022 | Capela Moraes et al. |
| 2022/0282695 | A1 | 9/2022 | Peviani |
| 2023/0109781 | A1 | 4/2023 | Alexander et al. |
| 2023/0175364 | A1 | 6/2023 | Al-huwaider et al. |
| 2024/0076953 | A1 | 3/2024 | Trifol et al. |
| 2024/0084687 | A1 | 3/2024 | Saponja et al. |
| 2025/0067150 | A1 | 2/2025 | Shakeel et al. |
| 2025/0067160 | A1 | 2/2025 | Shukor et al. |
| 2025/0067164 | A1 | 2/2025 | Gupta et al. |
| 2025/0084748 | A1 | 3/2025 | Fripp et al. |
| 2025/0101817 | A1 | 3/2025 | Steele et al. |
| 2025/0101822 | A1 | 3/2025 | Steele et al. |
| 2025/0101823 | A1 | 3/2025 | Steele |
| 2025/0101846 | A1 | 3/2025 | Steele et al. |
| 2025/0101848 | A1 | 3/2025 | Steele et al. |
| 2025/0101849 | A1 | 3/2025 | Steele et al. |
| 2025/0109675 | A1 | 4/2025 | Steele et al. |
| 2025/0109676 | A1 | 4/2025 | Butler et al. |
| 2025/0154860 | A1 | 5/2025 | Steele et al. |

FOREIGN PATENT DOCUMENTS

| | | |
|---|---|---|
| CN | 116733440 | 9/2023 |
| CN | 117552765 | 2/2024 |
| CN | 117569792 | 2/2024 |
| CN | 118057000 | 5/2024 |
| EP | 0977621 | 7/2002 |
| EP | 0948702 | 3/2003 |
| JP | 2002370005 | 12/2002 |
| WO | 1992009379 | 6/1992 |
| WO | 1996004056 | 2/1996 |
| WO | 2004007908 | 1/2004 |
| WO | 2010118351 | 10/2010 |
| WO | 2011119675 | 9/2011 |
| WO | 2014172324 | 10/2014 |
| WO | 2025071675 | 4/2025 |
| WO | 2025071676 | 4/2025 |
| WO | 2025071677 | 4/2025 |
| WO | 2025071678 | 4/2025 |
| WO | 2025071679 | 4/2025 |
| WO | 2025071680 | 4/2025 |
| WO | 2025071682 | 4/2025 |
| WO | 2025071683 | 4/2025 |
| WO | 2025071684 | 4/2025 |
| WO | 2025106689 | 5/2025 |

OTHER PUBLICATIONS

"PCT Application No. PCT/US2024/026689 International Search Report and Written Opinion", 13 pages.

(56) References Cited

OTHER PUBLICATIONS

"PCT Application No. PCT/US2024/026896 International Search Report and Written Opinion", Aug. 19, 2024, 13 pages.
"PCT Application No. PCT/US2024/026900 International Search Report and Written Opinion", Aug. 19, 2024, 12 pages.
"PCT Application No. PCT/US2024/027103 International Search Report and Written Opinion", Aug. 19, 2024, 11 pages.
"PCT Application No. PCT/US2024/027105 International Search Report and Written Opinion", Oct. 10, 2024, 11 pages.
"PCT Application No. PCT/US2024/027565 International Search Report and Written Opinion", Sep. 6, 2024, 14 pages.
"PCT Application No. PCT/US2024/027573 International Search Report and Written Opinion", Sep. 9, 2024, 11 pages.
"PCT Application No. PCT/US24/28078 International Search Report and Written Opinion", Aug. 14, 2024, 9 pages.
"BaraCRI™ Cuttings Reinjection Operations Save More Than US 4 Million on Six-Year Project", Halliburton, www.halliburton.com, 2018, 2 pages.
"BaraCRI™ Cuttings Reinjection System Saves Operator USD 120,000 Per Month", Halliburton, www.halliburton.com, 2018, 2 pages.
"BaraCRI™ Services Help Reduce Environmental Impact in First CRI Application in Ecuador", Halliburton, www.halliburton.com, 2018, 2 pages.
"Cuttings Reinjection Video", SLB; https://www.slb.com/videos/cuttings-reinjection-service, Sep. 8, 2016, 4 pages.
"IWISE: Integrated waste injection services", Mi SWACO: a Schlumberger Company, 2016, 6 pages.
"Whirlaway Gas Handlers", ChampionX Artificial Lift, Nov. 4, 2020, 2 pages.
"Workstring Orientation Tool: Orientation Accuracy in Multilateral Completion Operations", Halliburton Completion Tools, 2020, 2 pages.
Alshmakhy, et al., "Use of Downhole Oil-Water Separation System in Horizontal Wells", 2021 SPE Annual Technical Conference and Exhibition, Sep. 2021, 5 pages.
Catala, "Fluid Flow Fundamentals", Oilfield Review, 1996, 4 pages.
Ezell, et al., "First Successful Field Utilization of Cuttings Re-Injection (CRI) in the Offshore Field of Saudi Arabia as an Environmentally Friendly and Cost Effective Waste Disposal Method", SPE Annual Technical Conference and Exhibition held in Denver, Colorado, USA, Nov. 2011, 14 pages.
Guo, et al., "Increased Assurance of Drill Cuttings Reinjection: Challenges, Recent Advances, and Case Studies", Paper IADC/SPE 87972 presented at the IADC/SPE Asia PacificDrilling Technology Conference and Exhibition, Jun. 2007, 7 pages.
Hagan, et al., "Engineering and Operational Issues Associated with Commingled Drill Cuttings and Produced Water Re-injection Schemes", SPE International Conference on Health, Safety and Environment in Oil and Gas Exploration and Production held in Kuala Lumpur, Malaysia, Mar. 2022, 9 pages.
Hernandez, et al., "Drill Cutting Reinjection Feasibility Study in a Critical Environment, Apaika Field, Ecuador", SPE Latin American and Caribbean Health, Safety, Environment and Sustainability Conference held in Bogotá, Colombia, Jul. 2015, 21 pages.
Kuhnen, et al., "Destabilizing Turbulence in Pipe Flow", Nature Physics vol. 14, 386-390 (2018), 2018, 36 pages.
Kuhnen, et al., "Like Cures Like: How to Destroy Turbulence With Turbulence", APS Physics; YouTube Video https://youtu.be/gZgtT-JxmtM?si=zBHluksDm75LCQuw, Nov. 14, 2017.
Ladmia, et al., "Downhole Oil Water Separation to Handle Produced Water Study Case Onshore & Offshore Fields Abu Dhabi", SPE Annual Technical Conference and Exhibition, Dubai, UAE, Sep. 2021, Sep. 15, 2021.
Marusic, et al., "An Energy-Efficient Pathway to Turbulent Drag Reduction", Nature Communications vol. 12, Article No. 5805 (2021), 2021, 8 pages.
McCoy, et al., "Evaluation and Performance of Packer-Type Downhole Gas Separators", SPE Production and Operations Symposium, Mar. 2023, 14 pages.
Muktadir, et al., "Review and Applicability of Downhole Separation Technology", 2016, 13 pages.
Poclin, et al., "Commingled Reinjection of Cuttings and Produced Water Provides a Zero-Discharge Solution for the Development Phase of the Pirana Field in the Peruvian Amazon Region", SPE Latin American and Caribbean Petroleum Engineering Conference held in Quito, Ecuador, Nov. 2015, 18 pages.
Samy, "Cutting Re-injection CRI Uncertainty and Risk Assessment", SPE Abu Dhabi International Petroleum Exhibition & Conference to be held in Abu Dhabi, UAE,, Nov. 2021, 15 pages.
Scarselli, et al., "Turbulence Suppression by Cardiac-Cycle-Inspired Driving of Pipe Flow", Nature vol. 621, pp. 71-74 (2023), Sep. 6, 2023.
Schuh, et al., "Case History: Cuttings Reinjection on the MurdochDevelopment Project in the Southern Sector of the North Sea", Paper SPE 26680 presented at the Offshore European Conference held in Aberdeen, 1993, 16 pages.
Yang, et al., "Application of DOWS (Downhole Oil Water Separation) Technology Used in High Water-Cut Oilfield: Case Study", SPE/IATMI Asia Pacific Oil & Gas Conference and Exhibition, Oct. 2015, 8 pages.
Zunce, et al., "Study on the Flow Pattern of Downhole Oil-Water Separator with Different Inlet Patterns", 2009 3rd International Conference on Bioinformatics and Biomedical Engineering, Jun. 2009, 4 pages.
"PCT Application No. PCT/US2024/055948 International Search Report and Written Opinion", Mar. 7, 2025, 13 pages.
"U.S. Appl. No. 18/647,581 Non-Final Office Action", Apr. 22, 2025, 17 pages.
"U.S. Appl. No. 18/647,393 Non-Final Office Action", Apr. 7, 2025, 21 pages.
"U.S. Appl. No. 18/648,824 Non-Final Office Action", Mar. 27, 2025, 11 pages.
"U.S. Appl. No. 18/653,061 Non-Final Office Action", Mar. 18, 2025, 16 pages.
"U.S. Appl. No. 18/656,389 Non-Final Office Action", Apr. 24, 2025, 20 pages.
"U.S. Appl. No. 18/649,236 Non-Final Office Action", May 13, 2025, 13 pages.
"U.S. Appl. No. 18/647,015 Non-Final Office Action", Jun. 4, 2025, 19 pages.
"U.S. Appl. No. 18/651,918 Non-Final Office Action", Jun. 4, 2025, 15 pages.
"U.S. Appl. No. 18/653,061 Final Office Action", Jul. 3, 2025, 20 pages.
"U.S. Appl. No. 18/945,016 Non-Final Office Action", Jul. 22, 2025, 10 pages.
"U.S. Appl. No. 18/647,015 Final Office Action", Oct. 2, 2025, 24 pages.
"U.S. Appl. No. 18/647,393 Final Office Action", Aug. 22, 2025, 14 pages.
"U.S. Appl. No. 18/647,581 Non-Final Office Action", Oct. 28, 2025, 17 pages.
"U.S. Appl. No. 18/649,236 Final Office Action", Sep. 11, 2025, 17 pages.
"U.S. Appl. No. 18/651,918 Final Office Action", Sep. 30, 2025, 23 pages.
"U.S. Appl. No. 18/653,061 Non-Final Office Action", Nov. 20, 2025, 16 pages.

* cited by examiner

Drilling Type Underreamer (DTU)

POWERED ORIENTATION OF DOWNHOLE SEPARATORS IN A WELL

BACKGROUND

Oil and gas wells produce significant amounts of water in their lifetime. The percentage of water produced from these wells is called the water cut, the ratio of the water produced from the well compared to the volume of the total liquids produced. Most wells produce an ever-increasing water cut throughout their productive life. In many oil fields around the world the percentage of water recovered with oil has risen to be greater than the percentage of the oil. In fact, in many fields, the percentage of oil has decreased to be from about 20% in an excellent field to about 2% in a relatively poor field.

The end of a well's productive life is often determined by the water cut. A well is typically shut in when the value of the hydrocarbons produced is no longer sufficient to economically cover the operating costs of the well and the cost of disposing of the produced water. Indeed, disposing of the produced water is not environmentally and economically friendly as energy is used to power the pump to lift the produced water to the surface, to separate the produced water from the oil, to transport the separated water as it cannot be disposed on the surface in most cases. Thus, the separated water must be transported to a remote well site to be reinjected into a subterranean formation. Therefore, decreasing the water cut of a well increases the value of the produced fluids and directly decreases the disposal costs of the produced water.

One method of reducing the water cut of a well is to separate produced water from the hydrocarbons downhole, rather than at surface. Downhole separation increases the value of the fluids produced to the surface. Downhole separation also facilitates disposal of the separated water. The separated water can be reinjected into the same production zone or into a different zone. Another way to improve the productivity of a well is to increase the length of the intersection of the productive zone by the well completion. One way of increasing this intersection length is by using multilateral wells. A multilateral well is a conventional well that has a lateral well that is drilled from a point in the original well. The lateral well increases productivity by allowing additional intersection length along the productive zone without the cost and delay involved in redrilling the upper part of the well. While multilaterals enable multiple intersections within the same productive zone, multilaterals also enable fluid communication with different productive zones within a reservoir. In certain reservoirs, operators can leverage this approach to improve reservoir production by accessing numerous production zones or by increasing the contact area between a wellbore and a formation with minimal increase in drilling and completion costs. These techniques also reduce the environmental footprint of drilling rigs and subsequent production trees, particularly for land operations. Therefore, the use of multilateral well increases the potential production of a well and can also enable disposal of the produced water in a different zone.

BRIEF DESCRIPTION OF THE DRAWINGS

Embodiments of the disclosure may be better understood by referencing the accompanying drawings.

DESCRIPTION

Figure 1:
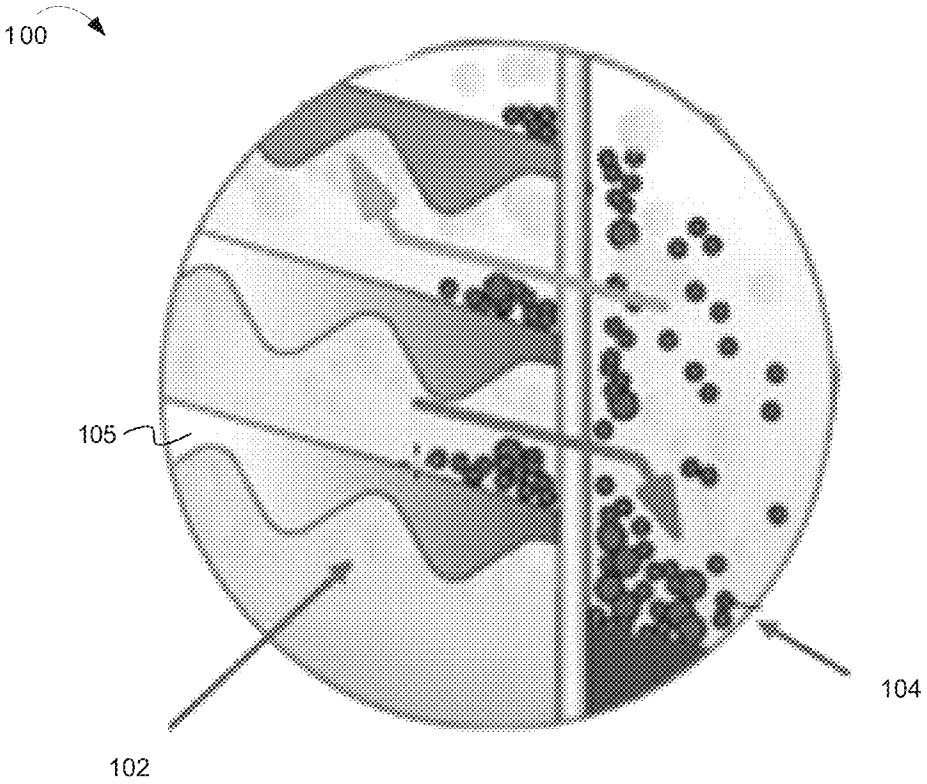
FIG. 1 is a perspective view of a solids separator.

As wells age, they may produce more water. To decrease the lifting and production cost related to produced water, Downhole Oil-Water Separation (DOWS) operations may be implemented to separate the water downhole and inject it into another portion of the well. This may include disposing of the separated produced water into one or more legs of a multilateral well. DOWS systems may include various devices that facilitate separation of solids, oil, water, gas and more. For example, a DOWS system may include a separator that may separate oil, water, and solids. This disclosure may refer to a DOWS system as a "DOWS." FIG. 1 is a perspective view of a solids separator. The solids separator 100 may include one or more corrugated plates 105 that catch oil 102 and cause solids 104 to fall into a collector. For the solids separator 100 to operate efficiently, it may be oriented withing a range of angles relative to gravity. That is, the solids separator 100 may operate best when the plates 105 are oriented at a particular angle (or range of angles). If the plates 105 do not have enough slope, gravity will not cause the solids 104 to fall off the plates 105 into the collector. Hence, the orientation of the solids separator 100 may contribute to its effective operation.

Like the solids separator 100, many other devices in a DOWS system also may operate best at a respective specific orientation (or within a range of orientations). In aviation terms, the solids separator 100 (and other devices in a DOWS system) may work best within a certain range of pitch (degrees) and with a certain range of roll (degrees). The yaw of the separator 100 and other DOWS components may not affect their performance.

Some implementations include one or more controllers capable of determining the direction of gravity. Some implementations also may include a control system that changes orientation of devices in the DOWS system based on sensor input and the controller's determination about the orientation of the DOWS devices. For example, the solids separator 100 may include a sensor on one of the plates 105. The sensor may indicate that the plate 105 is too flat in pitch (orthogonal to the major axis of the well and orthogonal to gravity) but at the inclination in roll (coincident to the major axis of the wellbore and orthogonal to gravity) is ideal. The control system may reorient the solids separator 100 in pitch to a position at which gravity more efficiently moves the solids 104 off the plates 105 (into the collector). The control system may include one or more motors, actuator, or other device configured to provide force to reorient the solids separator 100 or other DOWS system device in pitch and roll. By periodically (or continuously) monitoring and modifying orientation of DOWS system devices, some implementations may enable the DOWS assembly to achieve higher overall performance.

Example System

One or more powered orientation devices or related components described herein may be used in concert with any of the systems and devices described herein (even if not shown). The powered orientation devices may be used to reorient devices in any of the systems described herein. For example, powered orientation devices may be used to reorient solids separators in a multilateral well system.

Figure 2:
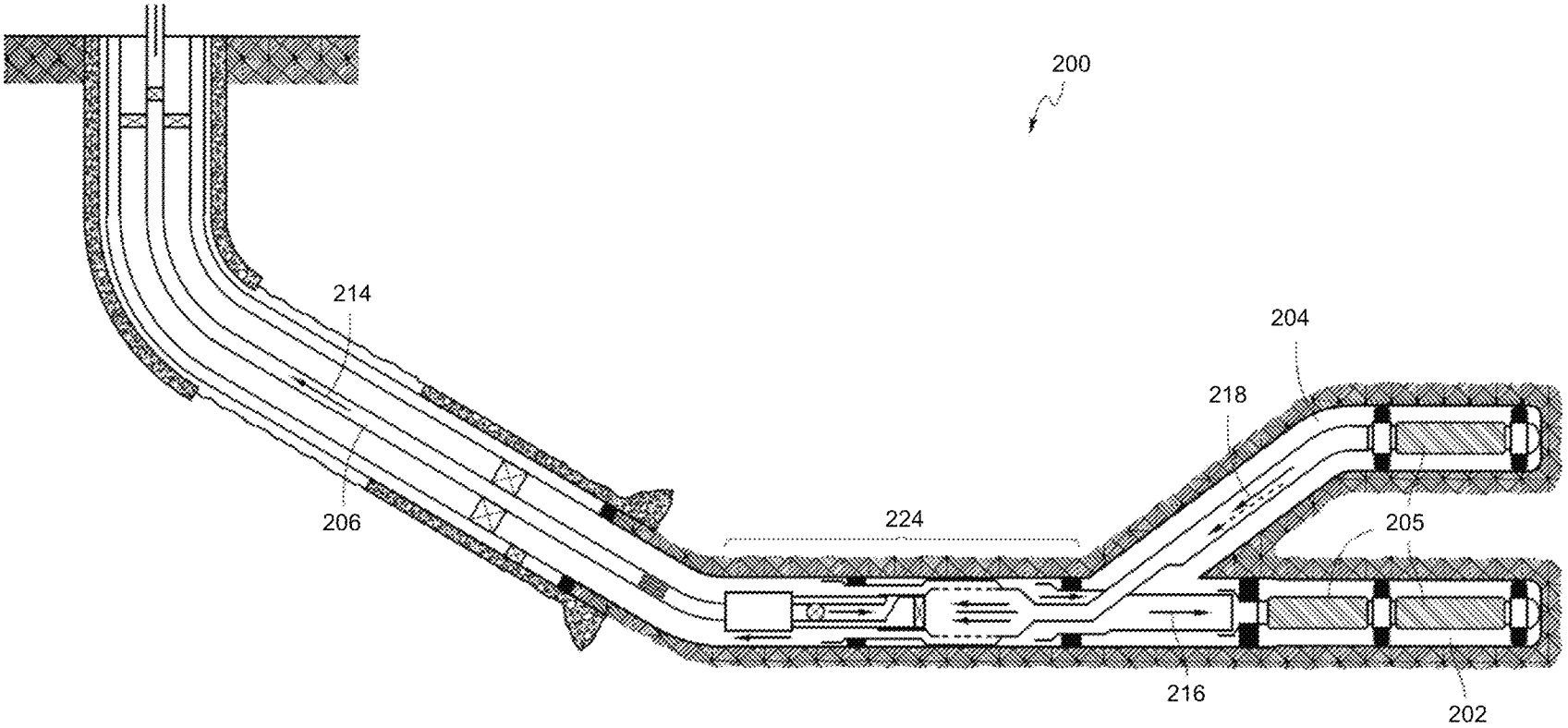
FIG. 2 is a perspective view in partial cross section of a multilateral well system that includes downhole fluid separation, according to some implementation.

FIG. 2 is a perspective view in partial cross section of a multilateral well system that includes downhole fluid separation, according to some implementations. FIG. 2 depicts a multilateral well that includes a main bore 202 and a lateral bore 204. The main bore 202 may include an open hole horizontal well. The lateral bore 204 may be an open hole inclined well. Screens 205 may be positioned in the main bore 202 and the lateral bore 204. For example, one of the screens 205 may be positioned in the lateral bore 204 at the point where the formation fluid 218 enters the tubing to prevent the larger solids from even entering the tubing. While described as being screens, alternatively or in addition, slotted liners, perforated tubing, etc. may be used to prevent the larger solids from entering the tubing. In some implementations, the screens 205 may prevent larger solids from entering the formation (such as when the formation is being utilized to store non-production fluid).

In FIG. 2, a system 200 includes a separation system 224 that may include a combination of separators for both fluid and solids (such as sediment). The separation system 224 may include pumps and sediment injectors. An example of the separation system 224 is depicted in FIG. 2 (which is further described below). A formation fluid 218 from the lateral bore may be drawn into the separation system 224. The separation system 224 may include a fluid separator to separate the formation fluid 218. The fluid separator may separate the formation fluid 218 into a production fluid 214 (such as hydrocarbons (e.g., oil)) and a nonproduction fluid 216 (such as water). The production fluid 214 may be delivered uphole through a production tubing string 206. The nonproduction fluid 216 may be delivered to the main bore 202 for injecting into the surrounding formation. Thus, example implementations may separate the nonproduction fluid downhole such that the nonproduction fluid may be directed back to the formation without any need to pump it back to the surface for separation and any transportation needed for storage. In some implementations, another wellbore may be drilled in the subsurface formation (i.e., a well with a surface location different than the multilateral well), where the nonproduction fluid 216 may be transported to for storage. For example, the nonproduction fluid 216 may be transported to the surface, via the multilateral well depicted in FIG. 2, and transported to another well for storage.

The nonproduction fluid 216 may include sediment. In some implementations, the sediment may be separated out from the nonproduction fluid 216 prior to the nonproduction fluid 216 being injected back a subsurface formation. For example, a cyclonic solids separator may separate the sediment from the nonproduction fluid 216. Therefore, the separation system 224 may also include sediment separator(s) to separate out sediment from the nonproduction fluid 216.

In some implementations, the sediment that has been separated out may be stored downhole (at least temporarily). In some implementations, the sediment may be delivered to the surface of the multilateral well or another downhole location using a flow channel (such as a tubing string). Examples of another downhole location may include a cavern, a disposal wellbore, a thief zone, etc. This flow channel may be the production tubing string 206 used to deliver production fluid to a surface of the multilateral well. In some implementations, this flow channel may be a separate tubing string for delivery of the sediment and/or other fluids to the surface of the multilateral well or to a different downhole location.

In some implementations, the separation system 224 may include sediment injector(s) to receive the sediment separated out by the sediment separator(s). The sediment injector(s) may inject this sediment into the production tubing string 206 (used to deliver the production fluid to a surface of the multilateral well) to deliver this sediment to the surface of the multilateral well. Alternatively, or in addition, the sediment injector(s) may inject this sediment into a separate tubing string to deliver this sediment to the surface of the multilateral well or to a different downhole location.

Figure 3:
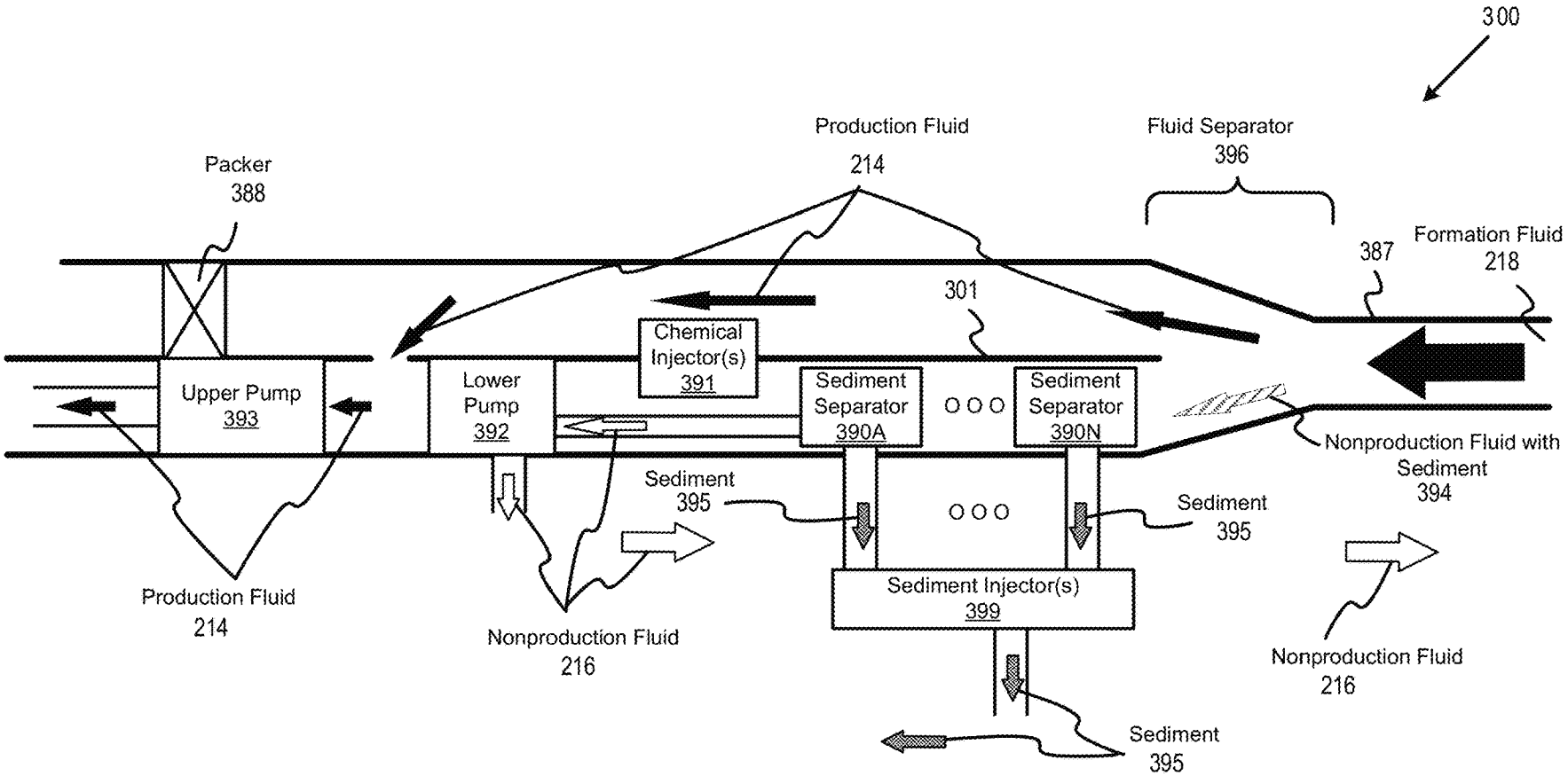
FIG. 3 is side view of an example downhole separation system (including a fluid separator, sediment separator(s), and sediment injector(s)), according to some implementations.

FIG. 3 is side view of an example downhole separation system (including a fluid separator, sediment separator(s), and sediment injector(s)), according to some implementations. For example, FIG. 3 depicts a separation system 300 that may be an example of the separation system 124 depicted in FIG. 1. The separation system 300 includes a tubing 387 that includes a fluid separator 396, sediment separators 390A-390N, chemical injector(s) 391, a lower pump 392, an upper pump 393, sediment injector(s) 399, a separator 301 (such as a FluidSep separator), and a packer 388. Also, while the separation system 300 is depicted in a given order, example implementations include a separation system with components that are reordered or changed.

The formation fluid 218 flows into the fluid separator 396. In this example, the fluid separator 396 comprises a gravity-based separation that includes the separator 301. As shown, the formation fluid 218 moves from a smaller to a larger diameter of the tubing 387. This may decrease the velocity of the flow of the formation fluid 218—which allows the separation. In particular, most, or at least a majority of the production fluid 214 may separate into a flow above the separator 301, while most or at least a majority of the nonproduction fluid with sediment 394 may separate into a separate flow below the separator 301. This may allow most of the sediment to be captured in the lower portion of the tubing 387 (below the separator 301).

While depicted as having the separator 301, in some implementations, there is no separator 301. Rather, the production fluid 214 and the nonproduction fluid with sediment 394 may naturally separate in a horizontal pipe because of their different density. Accordingly, even in a same tubing without the separator 301, most of the production fluid 214 would be above the nonproduction fluid 216 because of the differences in weight between the two types of fluid.

The nonproduction fluid with sediment 394 flows into the sediment separators 390A-390N, which may represent one to any number and type of separators. For example, the sediment separators 390A-390N may include cyclonic solids separators. In some implementations, each of the sediment separators 390A-390N may separate some of the sediment in the nonproduction fluid with sediment 394. For example, the first sediment separator 390 may be used to separate and collect the largest size (denser) sediment; the second sediment separator 390 may be used to separate and collect the next largest size sediment; the third sediment separator 390 may be used to separate and collect the next largest size sediment; etc. (as the flow moves from right to left through the different sediment separators 390A-390N). For example, at least one of the sediment separators 390 may be a hydrocyclone—wherein larger (denser) particles in the rotating stream have too much inertia to follow the tight curve of the stream. Such particles may thus strike the outside wall and fall to the bottom of the cyclone where they may be removed. In some implementations, each of the sediment separators 390 may store the sediment that was collected into an associated storage area or tank (i.e., a solids accumulator).

In some implementations, the separation system 300 and/or any one or more of the components within the separation system 300 may be oriented with respect to gravity. For example, components such as the fluid separator 396, separator 301, sediment separators 390A-N, etc. may be oriented with respect to gravity such that gravity may assist in separating the phases of the formation fluid 218, sediment 395 from the formation fluid 218, etc.

Additionally, the chemical injector(s) 391 may inject one or more chemicals into at least one of the formation fluid 218, the production fluid 214, the nonproduction fluid with sediment 394, the nonproduction fluid 216, or the sediment 395. While depicted such that chemicals are injected downhole, alternatively or in addition, chemicals may be injected from the surface of the multilateral well. Also, different chemicals may be injected for different purposes. For example, a flocculant or deflocculant may be injected to promote or not promote aggregation or settling of suspended particles in a liquid. Other examples of chemicals being injected may include paraffin, solvents, dispersants, etc. being added to the production fluid 214, a scavenger being added to the production fluid 214 to remove corrosive gases ($H_2S$) therefrom, etc. In particular, crude oils often contain paraffins which precipitate and adhere to the liner, tubing, sucker rods and surface equipment as the temperature of the producing stream decreases in the normal course of flowing, gas lifting or pumping. Heavy paraffin deposits are undesirable because they reduce the effective size of the flow conduits and restrict the production rate from the well. Where severe paraffin deposition occurs, removal of the deposits by mechanical, thermal, or other means is required, resulting in costly down time, and increased operating costs.

In some implementations, these different collections of the sediment by the different sediment separators 390 may be injected into a same or different line or tubing for disposal. As shown, the sediment injector(s) 399 are coupled to receive the sediment collected by the different sediment separators 390.

Periodically, sediment may need to be emptied from the different sediment separators 390 via the sediment injector(s) 399. The decision of when may be based on different criteria. For example, pressure and/or production flow may be monitored at the surface of the multilateral well. If the pressure and/or production flow start to degrade, it may be an indication that sediment needs to be emptied from the sediment separators 390.

In some implementations, sensors may be coupled to each of the tanks of the sediment separators 390. A signal from a given sensor may indicate when the associated sediment separator 390 needs to be emptied. A controller (downhole or at the surface of the multilateral well) may be communicatively coupled to the sensors such that the controller may initiate a sequence to empty one or more of the tanks of the sediment separators 390.

In some implementations, each of the temporary storage tanks (i.e., solids accumulators) for the corresponding sediment separator 390 may be configured with a solid mover, such as an auger. When a sediment separator needs to be emptied, the solids mover may be activated to empty the solids from the solids accumulator.

In some implementations, the sediment injector(s) 399 may dispose of these sediments by injecting them into a tubing for delivery to the surface of the multilateral well. For example, the sediment may be delivered to the surface using the production tubing or a separate tubing. If the production tubing is used, the solids may be included with the production fluid that is being delivered to the surface. In such implementations, separation operations may be performed at the surface to separate out the solids from the production fluid 214.

Accordingly, if sediment is included with the production fluid 214 being delivered to the surface, the production fluid 214 may be delivered to surface equipment that provides for separation of the sediment. Alternatively, during the time when the sediment is not being included with the production fluid 214, the production fluid 214 may be delivered to different surface equipment that does not include such separation of sediment.

Alternatively, or in addition, the sediment injectors 399 may deliver the sediment to a different downhole location (such as a different lateral well, a thief zone (having a high porosity, high permeability downhole zone that may include a low pressure), etc.). In some implementations, sediment may be disposed to different locations depending on their size. For example, for sediment having a size greater than X, such solids may be delivered to the surface of the multilateral well for disposal. For sediment having a size less than X but greater than Y, such sediment may be disposed in a first downhole location (such as a thief zone). For the remaining sediment that have a size less than Y, such solids may be disposed in a second downhole location (such as a lateral well).

Accordingly, example implementations may detect the accumulation of solids in DOWS equipment. An operator (or other device) may be signaled that the solids should be removed. In response, an operational change in the DOWS equipment may be initiated to allow solids removal. For example, this may include shut down or reduction of DOWS-related operations (decrease or shut down pumps, switch valves that direct fluids to the surface and/or other location, etc.). Preparation of the solid's removal process may be initiated. For example, access sleeves and flushing ports may be opened, solids directional control equipment may be adjusted (e.g., change position), injection devices, sleeves, ports, valves, etc. may be closed, solids processing/removal equipment (from surface and/or downhole) may be deployed, etc. Additionally, flushing, dislodging, scrapping, chemically treating, fluidically treating, mechanically treating, etc. of downhole solids from one or more locations downhole may be enabled. Solids and related debris from the DOWS system may be displaced. In some implementations, solids and other materials may be collected from the DOWS. When solids are separated and/or collected, the DOWS may be referred to as a downhole oil-water-solids separator (DOWSS). This disclosure may refer to a DOWSS system as a "DOWSS." The term DOWS may include DOWSS, so this disclosure may use the terms DOWS and DOWSS interchangeably. In some instances, a DOWS may include devices or functionality for separating solids. The solids and other materials may be transported from the DOWS. Fluids, chemicals, solvents, acids, liquids, abrasive media, solids and other materials may be transported from the surface to the DOWSS.

Items such as water, chemicals and other items listed above may be transported in a controlled manner. For example, the transporting in a controlled manner may be based on speed, velocity, volumes, ratios, time-based (e.g., until a certain amount of time has passed), function-based (e.g., until a certain pressure-drop is experienced, until fluid has been circulated "bottoms up", etc.). For example, the transporting in a controlled manner may be based on when Z number of tubing strings of fluid has been pumped or until X-amount (e.g., pounds, mass, volume, etc.) of debris has been recovered, collected, injected, disposed, transferred, etc. Tools, devices, flow, etc. may be moved, shifted, directed, etc. to improve the solids collecting, removal, retaining, and flushing process(es). For example, a direction of a jetting nozzle may be changed, one flushing port may be closed while opening another, etc. Tools, devices, components, strings, etc. may be repositioned from one location to another to continue the one-or-more above processes. Additionally, tools, devices, components, strings, etc. may be repositioned to dispose of solids in a preferred location.

One or more fluids, chemicals, solvents, acids, liquids, abrasive media, solids and other materials may be moved from the surface of the well to the DOWSS to enhance the longevity of the DOWSS. This may include applying and/or re-applying friction reducing coatings, replacing components-filters, stators, pumps, rotors, bearings, bearing assemblies, worn parts, eroded parts, electrical components, sensors, computers, controllers, logic devices, parts intend to be consumed including wear pads, erosion pads, corrosion pads, filters, screens, etc.

Also, the shutting down of the solid's removal process may be initiated. For example, access sleeves and flushing ports may be closed, solids directional control equipment may be adjusted. Injection devices, sleeves, ports, valves, etc. may be opened. Solids processing and removal equipment may be retrieved (from the surface and/or other location downhole. Used or worn devices from well may be retrieved. Such devices may include filters, stators, pumps, rotors, bearings, bearing assemblies, worn parts, eroded parts, electrical components, sensors, computers, controllers, logic devices, parts intend to be consumed including wear pads, erosion pads, corrosion pads, filters, screens, etc.

An operational change in the DOWS equipment may be initiated to allow fluid separation again. This may include "turning on" or increase of DOWSS-related operations (e.g., increase or turn-on pumps, switch valves that direct fluids to the surface and/or downhole, etc.). Also, the operator (or other device) may be signaled that the DOWSS equipment has been re-configured out of the solids-removal status and is ready to begin fluid separation operations. The DOWS may then return back to fluids separation mode. Additionally, there may be provided a continuous or occasional status check of the "health" of DOWS equipment.

It should be noted that the DOWS system and components noted may be inclusive of items from the wellhead to the toe of each wellbore and more. The cables and/or energy conduits that provide power to the one or more ESPs and/or other pumps and prime movers (downhole and on surface) may be inclusive. The surface components that transport the fluids and solids (everything) out of the well may be included. Subsea trees, subsea DOWS equipment, platform, land-base, jack up, drillship, etc. types of equipment may be inclusive. Data lines, data processing, sensors, in the well and outside of the well may be inclusive. Fluid processing equipment and processes in the well and outside of the well may be inclusive. Solids processing equipment and processes in the well and outside of the well may be inclusive.

Example implementations may be applied to other types of remote operations where the tools, operations, processes are separated from the operators by distances, barriers, adverse environments, etc. The ability to remotely test to determine or verify whether functions were performed successfully and then communicate or report the tests results to a locale inhabitable by humans (e.g. the earth's surface) makes example implementations suitable for use in other remote locations with harsh environments such as outer space (e.g., satellites, spacecrafts, etc.), aeronautics (aircrafts, drones), on-ground (swamps, marshes, power generation, hydrogen or other gas extraction and/or transportation, etc.), below ground (mines, caves, etc.), ocean (on surface and subsea), subterranean (mineral extraction, storage wells (carbon sequestration, carbon capture and storage (CCS), etc.)), and other energy recovery activities (geothermal, steam, etc.). The unhabitable environments may comprise corrosive fluids (hydrocarbons, H2S fluids, C02 fluids, acids, bases, gases, etc.), contaminants (sand, debris, paraffins, asphaltenes, etc.), high-temperature fluids (fluids from geothermal formations, injected fluids, etc.), cryogenic fluids, etc. Example implementations may be utilized in harsh conditions (e.g., corrosive environments or contaminated fluids), extreme pressures (e.g., >5,000-psi differential), extreme temperatures (e.g., >−20° F. or >300° F.), etc. In other instances, well-known instruction instances, protocols, structures, and techniques have not been shown in detail to avoid confusion.

Thus, in some implementations, the separators, pumps, and injectors may be installed at the junction between the main bore and the lateral bore. In other implementations, such devices may be installed below this junction or above this junction. Further, the main bore or one or more lateral bores may include one or more orientation devices which provides depth and orientation control. While example implementations include a given gravity-type separator, other types of separators may be used. For example, other gravity-type separators (e.g., fluid separators) and other non-gravity separators may be used.

Example implementations may include weir skimmers that function by allowing the oil floating on the surface of the water to flow over a weir. In some implementations, the weir skimmers may require the weir height to be manually adjusted. Alternatively, the weir skimmers may be such that the weir height is automatic or self-adjusting. While manually adjusted weir skimmer types may have a lower initial cost, the requirement for regular manual adjustment makes self-adjusting weir types more popular in most applications. Weir skimmers may collect water if operating when oil is no longer present. To overcome this limitation, the weir type skimmers may include an automatic water drain on the oil collection tank.

Some implementations are in reference to a "multilateral well." A multilateral well may be defined to include any type of well that has more than one bore, wellbore, branch, lateral, etc. For example, a multilateral well may include a main bore with one or more laterals branching therefrom. In another example, a multilateral well may also include any type of multi-bore well configuration with such bores at any angles relative to each other.

In some implementations, the separation system 300 may be installed at the junction between the main bore and the lateral bore. In other implementations, such devices may be installed below this junction or above this junction. Further, the main bore or one or more lateral bores may include one or more orientation devices which provides depth and orientation control. While example implementations include a given gravity-type separator, other types of separators may be used. For example, other gravity-type separators (e.g., FluidSep) and other non-gravity separators may be used.

The multilateral junction may be placed above or inside the target formation. In some implementations, this configuration may be accomplished in a two-trip multilateral completion that includes a lower completion with orientation liner hanger connected to additional lower completion, and an upper completion that includes the fluid separator, an electrical submersible pump, and an upper packer. This simplifies the installation. This reduced complexity allows the fluid separator to be installed into existing wells, i.e., retrofitting existing wells. Further, the lateral bore 204 may be a target formation. In this implementation, the main bore 202 passes through a target production formation and the lateral bore 204 passes through a target injection formation which is a separate formation from the production formation. The existing wells do not require a tangent section at the junction for the placement of the fluid separator, significantly increasing the number of oil well candidates for installation of the fluid separator according to example implementations.

Example implementations may be used in non-horizontal applications (inclined wells, extended reach wells, slant hole wells, vertical wells, S-wells, or combination thereof, etc.). In some applications, such as inclined wells, a flow diverter may be used in conjunction with other devices. The other devices may be one or more destabilizers, a gravitational separator, a non-gravitational separator, a combination of both gravitational and non-gravitational, a coalescing device, a cleaning device, another flow diverting device, a leveling device, an inclination device to monitor, sense, adjust, change the inclination of one or more devices with respect to gravity and/or the inclination of the well, an orientation device to monitor, sense, adjust, change the orientation and/or azimuthal position of one or more devices, systems etc. One or more orientation devices (powered and non-powered) may be used. Example implementations may include cartridges.

The design of the installed completion equipment may be critical for the downhole fluid separator to function as intended. By installing the fluid separators, pumps, and sediment injector in the main bore at or near the junction between the main bore 202 and the lateral bore 204, an existing watered out well may be re-entered. This decreases the overall cost involved in installing the separators, pumps, and sediment injector according to example implementations as compared with installing it at the completion of the well at the beginning of the life of the well. It also decreases the risks associated with installing these devices according to example implementations in existing wells that may be poor producers and represent a smaller cost if the well is lost during the trial as compared with selecting a potential well before well completion is finished. Using these separators and injectors in a downhole setting combined with a multilateral junction may provide efficiency gains.

This includes converting poor performing wells, wherein the percentage of oil has decreased to about 2% for example, into a downhole water injector combined with a better producing well. Additional benefits include lower flow rate and pressure rating requirements, a lighter fluid column, and increased recovery. Example implementations may be particularly useful in low flow rate wells (in the 200 barrel per day range or less), which tend to be shallow, and relatively inexpensive to drill. Moderate flow rate wells, for example 500-5000 barrels of fluid per day, may also be potential candidates for incorporating example implementations. Finally, it will also be useful for most multilaterals with very high flow rate wells, up to 50,000 barrels of fluid per day, for example.

Example implementations reference a production tubing string 106 for the delivery of fluids, sediment, etc. to the surface of the multilateral well or other downhole location. However, example implementations may use any type of flow channel, conduit, etc. for such delivery. For example, the sediment flow channel may be the annular space around the production tubing string 106. Additionally, while depicting the separation being performed uphole relative to the junction between the main bore 202 and the lateral bore 204, example implementations may position the separation at any other location downhole. For instance, the separation may be performed at the junction, below the junction, etc.

The DOWS system may include flow inlet devices, oil-separation devices, water-separation devices, self-deprecation devices, flow outlet devices, flow outlet conduits (tubing, screens, y's, tees, splitters, etc.), fluid transport devices, fluid screening devices, formation support devices (liners, casings, screens, injection ports, and valves (including Outflow Control Devices (including automatic, chokes, restrictors, regulating, etc.). The outflow control devices may comprise one or more features similar to inflow control devices such Inflow Control Devices (ICD's), Automatic Inflow Control Devices (AICD's), Gravity-based ICD's, AIDC's, etc., Viscous-based ICD's, AIDC's, etc., Inertial-based ICD's, AIDC's, etc., pumps, regulators, sensors, controllers, relays, transmitters, floats, etc.

Examples implementations may include an injecting-while-producing system—wherein one pump may be used to force fluid into one formation and a second pump may be used to produce fluid from a second zone. This single-bore water-flood solution maintains downhole pressure to reduce cycling and recover more oil in struggling wells. The injecting-while-producing system may inject from an upper zone and produce from the lower with the aid of isolation packers, or it can inject in the bottom zone and produce from a zone higher in the well.

Example Devices: Powered Orientation of Downhole Separators

All the example sensors and control systems described herein may operate in concert with one or more other devices such as fluid separators, coalescers, perturbation devices, and others. Some novel combinations may not be explicitly shown in the drawings but are with the scope of this disclosure. For example, one or more sensors and a control system for reorienting DOWS devices may be used with those devices. For example, one or more sensors in the control system may be used in concert with flow pipes, solids removers, coalescers, perturbation devices, and other devices. These one or more controllers and sensors may be referred to as an orientation monitoring and control device (OMCD), orientation monitoring and control system, and other names. In some implementations, the controller may include the sensors. In some implementations, multiple controllers may be used with multiple sensors. In some implementations, a single controller may be used with multiple sensors. Hence, any suitable combination of controllers and sensors may be utilized to monitor and control orientation of DOWS devices.

Figure 4:
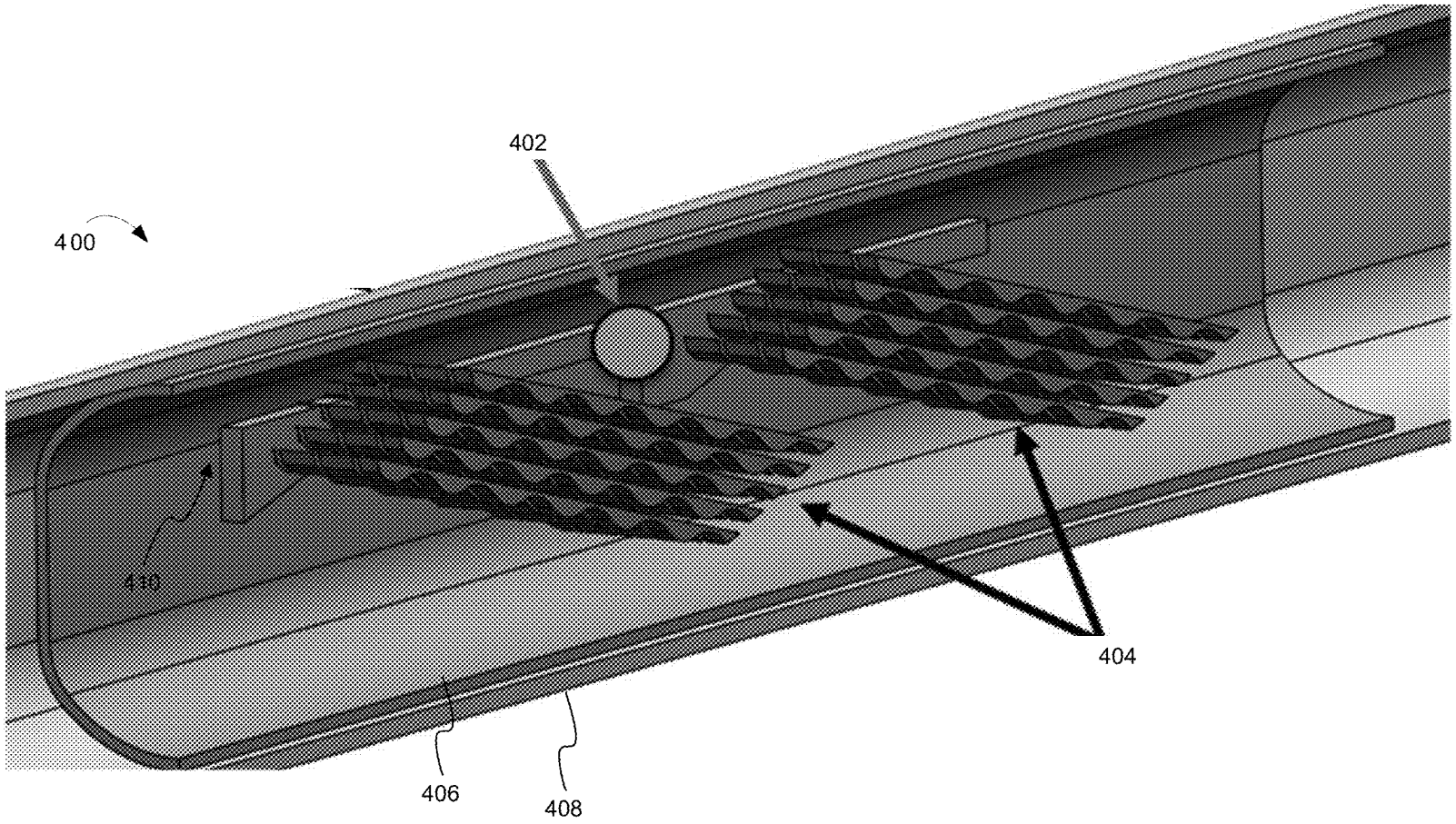
FIG. 4 is a perspective view of a DOWS assembly including flexible coalescers.

FIG. 4 is a perspective view of a DOWS assembly including flexible coalescers. As shown, the DOWS assembly 400 may include a housing 406 which fits inside a casing 408 in a multilateral well. The DOWS assembly 400 also may include flexible coalescers 404 configured to separate phases of fluid and/or solids flowing through the housing 406. The flexible coalescers 404 may (as a whole or with respect to one or more components of the flexible coalescer 404) flex without experiencing permanent deformation and/or detrimental damage that may cause the component or assembly to become inoperable or functional. Flexible may mean that one or more components has a flexibility greater than steel. In other words, the component may flex or bend as much or more than a similar component made out of steel without causing detrimental damage to the component or system. The properties that may define a material's stiffness may be the modulus elasticity or the modulus of rigidity. Some steels have a modulus of elasticity of about 200 Gpa. The individual coalescers 404 components may be designed/configured to have more stiffness in one direction that in another direction. For example, the components/plates may be designed to be stiff in the plane parallel to the axis of the wellbore and have increased flexibility in the direction perpendicular to the axis and near perpendicular to the direction of gravity. In some examples, the stiffness will be reduced in one or more directions to allow the plates to move/fold/open so cleaning tools, etc. may pass without damaging the tool, the plates, the coalescer and/or DOWSS system.

In some implementations, the coalescers 404 operate similarly to the plates 305 described with reference to FIG. 3. The coalescers may be coupled with the housing 406 via a mounting unit 410. The mounting unit 410 may include one or more actuators configured to change the orientation (such as by changing pitch and roll) of the coalescers 404. The DOWS assembly 400 also may include a controller 402 configured to determine the direction of gravity and reorient the mounting unit 410 and coalescers 404. In some implementations, the controller 402 may include an accelerometer, mechanical gravity-sensing device, or other suitable component for determining a direction of gravity. The controller 402 also may include logic for activating actuators or motors embedded connected to the mounting unit 410. The controller 402 may adjust orientation of the coalescers 404 based on its determination about the direction of gravity and also information indicating an orientation at which the coalescers operate most efficiently. The controller 402 may adjust the orientation of individual coalescers 404, multiple coalescers 404, rows of coalescers, columns or coalescers 404, half of the coalescers 404, or any combination of coalescers 404. In some examples, one or more or all components of the mounting unit 410 may move or articulate with the one or more coalescers. In one or more examples, one or more other component(s) of the DOWS assembly 400, including housing 406, may move or articulate. In some examples, one or more devices attached to the DOWS assembly 400 may move, articulate, swivel, anchor, etc. with or separately from a component of DOWS assembly 400. For example, at one or both ends of DOWS assembly 400, there may be a swivel to allow the DOWS assembly 400, or parts thereof, to rotate about a longitudinal axis running substantially parallel to the wellbore. In some examples, one or more components of DOWS assembly 400 (e.g., 402, 410, etc.) may be segregated/isolated from the flow fluid(s) and solids. For example, bearings, bushings, motors, power connectors, sensors, parts of sensors, etc. maybe protected from erosional, corrosion, impingement, vibrational, mechanical, and/or chemical effects of the fluid(s) and/or solid(s) and/or emulsion(s) and/or chemicals (injected or naturally occurring) present in the well/well system/DOWS/DOWSS, etc.

The coalescer/DOWS system may include teeth to move the coalescers 404 and/or 410 and/or 402 and/or 406 or any combination thereof. The coalescer/DOWS assembly 400 may include one or more component(s) such as a thread, a seal or other apparatuses at its upper end (left end) and/or lower end (right end) to hydraulically seal and/or mechanically attach it to another tubular (e.g., tubular 387) or another device (e.g. a DOWS component or fluid separator 396) or another component of 400. The coalescer/DOWS assembly 400 may include one or more components that may include one or more components such as a thread, a seal or other apparatus at its upper end (left end) and/or lower end (right end) to hydraulically seal and/or mechanically attach it to another tubular (e.g., tubular 387) or device (e.g. a DOWS component or fluid separator, 396, or other component).

Figure 5B:
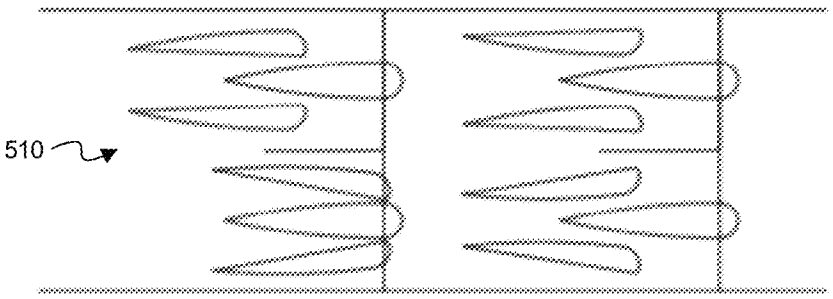
FIGS. 5A-5B are sectional views of a DOWS assembly in a well.
Figure 5A:
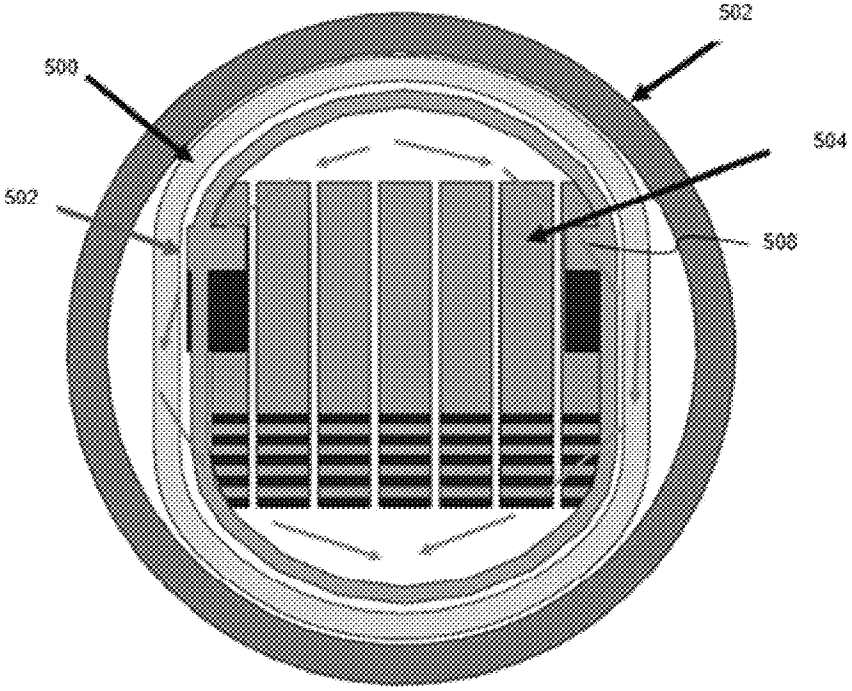

FIG. 5 is a sectional view of a DOWS assembly in a well. In The DOWS assembly 500 may be disposed inside a casing 502 of a well. The DOWS assembly 500 also may include a flexible coalescer 504. The flexible coalescer 504 may be retrievable, re-dressable, and rerunnable. The DOWS assembly 500 may include a controller 506 configured to monitor and modify orientation of one or more of the plates/strips/strands of the flexible coalescer 504. In some implementations, the one or more of the plates/strips/strands of flexible coalescer 504 may operate best when oriented at a slight incline with respect to the force of gravity and along the centerline of the well bore; in other words, with a slight roll to the one or more components of the flexible coalescer 504. In some implementations, the one or more of the plates/strips/strands of flexible coalescer 504 may operate best when oriented at a slight incline to the force of gravity and perpendicular to the centerline of the well bore; in the vernacular of aircraft flight dynamics, the pitch of the one or more plates/strips/strands of the flexible coalescer 504. In some implementations, the plates of the coalescer 504 may rotate in different directions than the other plates. For example, the plates on the left side of the wellbore's axis may better positioned when tilted so the gas may rise to the upper quadrant of the wellbore (as shown). The plates to the right side of the axis may be better positioned if they are tilted at another angle so the gas from them will also rise to the upper portion of the wellbore. Likewise, in some implementation, the orienting of the individual plates/strips may enhance solids removal/collection/disposal.

In some implementations, the coalescers may take on other shapes and/or forms. As a non-constraining example, the coalescers may have the shape of one or more hydrofoils. FIG. 5B is a perspective view of an example of coalescers in the shape of a hydrofoil. In one example, the leading hydrofoils 510 may serve one or two purposes 1) to stabilize the flow-reduce turbulence, create a laminar flow, etc. The coalescer may function as a separator by reducing the velocity of solids when they impact the one or more hydrofoils. The leading hydrofoils may also initiate/enhance/improve the separation of fluid due to one or more phenomena. For example, the change of momentum of denser fluids will be different than light fluids. A oil/water mixture may have an increased propensity to separate when coming in contact with the hydrofoils, or experiencing another change do to change in flow path (direction) or velocity/momentum/surface characteristic (roughness/coefficient of friction/attraction to one or more other solids/surfaces/fluids/etc. (i.e. water is repelled by certain surfaces or liquids) (e.g., the hydrofoils can exert a lifting force and compression force on the fluids that pass by) There may be additional sets of hydrofoils included with the coalescer. The hydrofoils may function together (e.g., one mechanism, controller, actuator, control algorithm, etc.) Or one or more hydrofoils may be completely different-different materials, controls, functions, etc.

The upper hydrofoils 1224-1226 and 1230-1231 may be different than the lower hydrofoils for many reasons. For example, the light fluids will be on top (e.g., lighter hydrocarbons on top; heavier hydrocarbons on bottom). The lower fluid may have a higher water content (even after being processed by one or more DOWS or DOWSS). There may be a thin layer of water or water+solids on the bottom. In some examples, there may be more than 2 sets of hydrofoils that are different (or the same) as the other hydrofoils (remember hydrofoils=coalescers=flow adjusters (destabilizers, stabilizers, separators, buoyancy separators, etc.). For example, a 3$^{rd}$ set of hydrofoils/separators/coalescers may be inserted between the 2 existing horizontal sets Upper sets: (1224-1226+1230-1232) and Lower sets (the rest). The 3$^{rd}$ set may "work" on the "Basic Sediment" that may exist between the oil and water interface.

The hydrofoils may be arranged in clusters of three with one or more clusters above one or more others. The upper hydrofoils may be different than the lower hydrofoils for many reasons. For example, the light fluids will be on top (e.g., lighter hydrocarbons on top; heavier hydrocarbons on bottom). The lower fluid may have a higher water content (even after being processed by one or more DOWS or DOWSS). There may be a thin layer of water or water+solids on the bottom. In some examples, there may be more than 2 sets of hydrofoils that are different (or the same) as the other hydrofoils (remember hydrofoils=coalescers=flow adjusters (destabilizers, stabilizers, separators, buoyancy separators, etc.). For example, a 3$^{rd}$ set of hydrofoils/separators/coalescers may be inserted between the 2 existing horizontal sets Upper sets; and Lower sets (the rest). The 3$^{rd}$ set may "work" on the "Basic Sediment" that may exist between the oil and water interface.

The flexible coalescer 504 may be mounted to the DOWS assembly 500 via one or more mounting units 508. The controller 506 may be capable of reorienting the flexible coalescer 504 by controlling actuators connected to the mounting units 508. In some implementations, the controller 506 periodically or continuously monitors orientation of the flexible coalescer 504 (such as by detecting the direction of gravity). If the orientation of the flexible coalescer 504 is outside a particular range of angles with respect to the direction gravity, controller 506 may reorient the flexible coalescer 504 to be within the range. Therefore, controller 506 may improve performance of the flexible coalescer 504 by increasing its time within a specified orientation.

Figure 6:
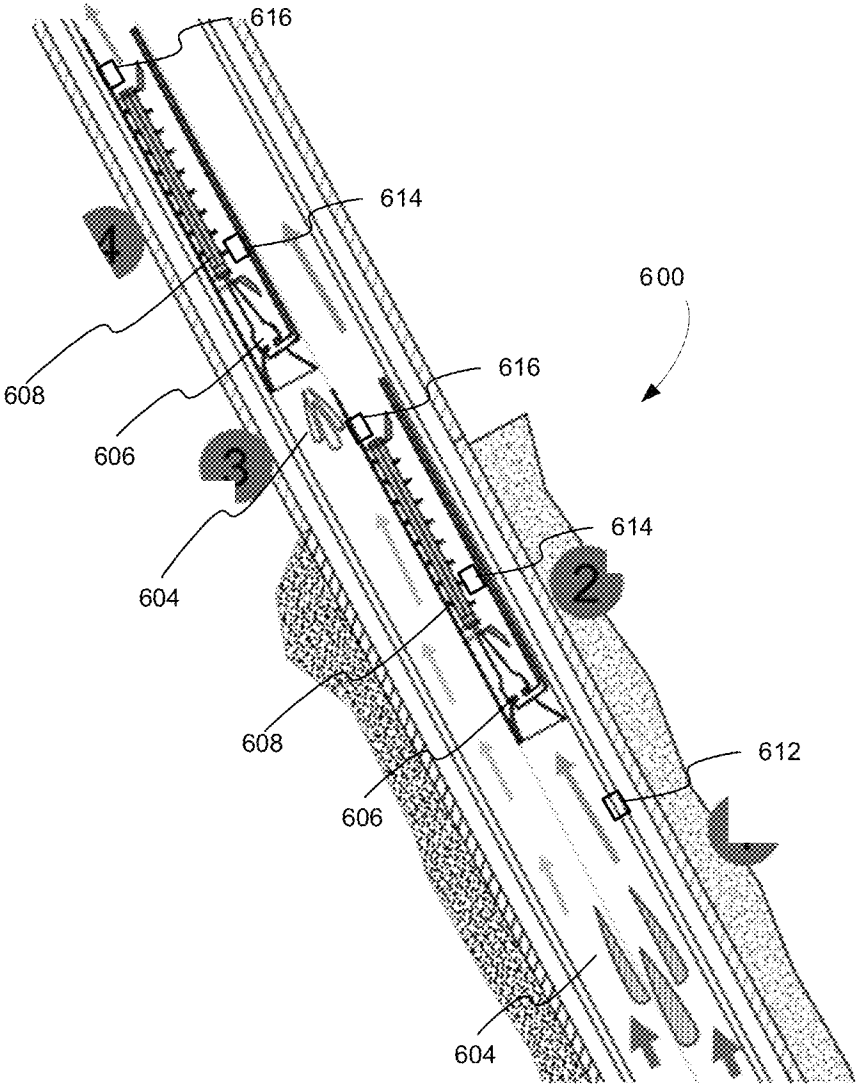
FIG. 6 is a sectional view of a DOWS assembly disposed in a multilateral well.

FIG. 6 is a sectional view of a DOWS assembly disposed in a multilateral well. The DOWS assembly 600 may be disposed in a casing inside a semi-vertical well. The DOWS assembly 600 may include components for separating solids from the phases of fluid and/or solids passing through the DOWS assembly 600. A DOWS assembly 600 may comprise a DOWSS assembly or one or more components thereof. The components for separating solids may include diverters 604, hydro cyclones 606, and conveyors 608, and other components. The DOWS assembly 600 also may include one or more sensors 614 and one or more controllers 612. In some implementations, the sensors 614 determine an orientation of the components of the DOWS assembly 600. For example, the sensors may determine an orientation of the conveyors 608, Hydro cyclones 606, diverters 604, or other components in the DOWS assembly 600. Each component may have an optimal orientation at which it operates. For example, some of the components may operate with higher performance when oriented within a range of orientations relative to the direction gravity and the axis of the wellbore. In other examples relative to the direction of gravity and an axis orthogonal to the centerline of the wellbore. In some examples, operations may be improved by when oriented within a range of orientations relative to both axes. However, in some instances, DOWS system and components described herein may operate with higher performance at certain orientations that are not related to gravity. Whichever the case, the controller 612 and sensors 614 may reorient DOWS devices. For example, using information from the sensors 614, the controller 612 may determine that the conveyors 608 have moved outside their optimal orientation range. The controller 612 may operate actuators 616 that reorient the conveyors 608, diverters/coalescers 604, (or other suitable DOWS devices). The actuators 616 can include electrical motors, linear actuators, or any other suitable device for reorienting components of the DOWS assembly 600.

Figure 7:
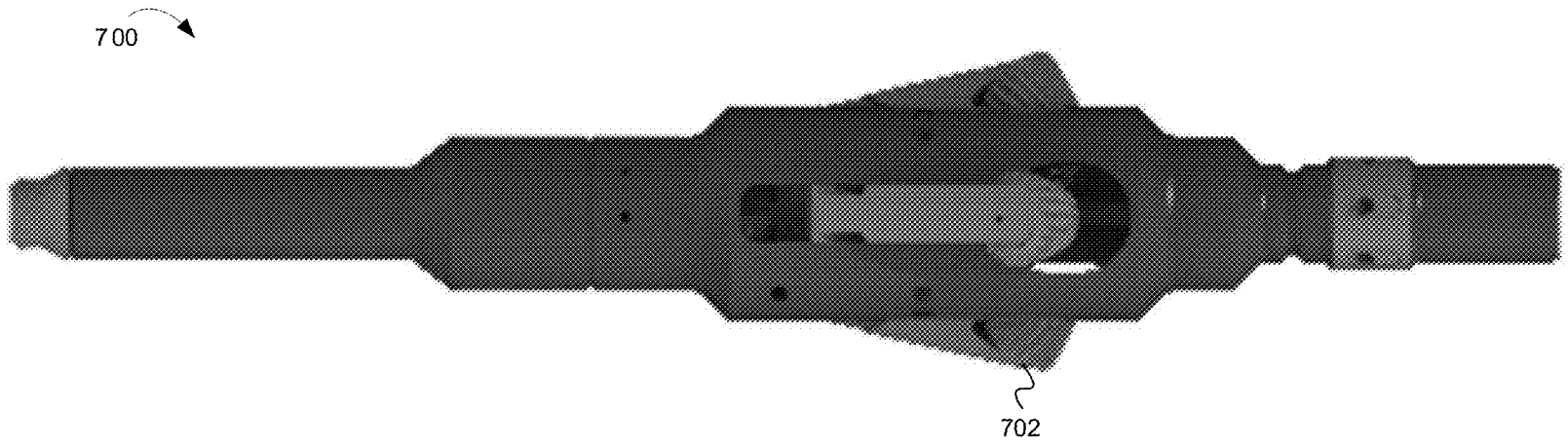
FIG. 7 is a perspective view of a cutting tool.

FIG. 7 is a perspective view of a cutting tool. The cutting tool 700 may be configured to remove material from a casing in a wellbore. The cutting tool 700 also may be configured to remove material from a formation. Some implementations may utilize the cutting tool 700 to create a larger space in which a DOWS system assembly may be installed. For example, the cutting tool 700 may remove a portion casing to create space for a DOWS assembly. The DOWS assembly may include any components described herein. For example, the DOWS assembly may include one or more sensors and one or more controllers for monitoring and modified orientations of components of the DOWS assembly (such as coalescers, conveyors, hydro cyclones, separators, and more).

Figure 8:
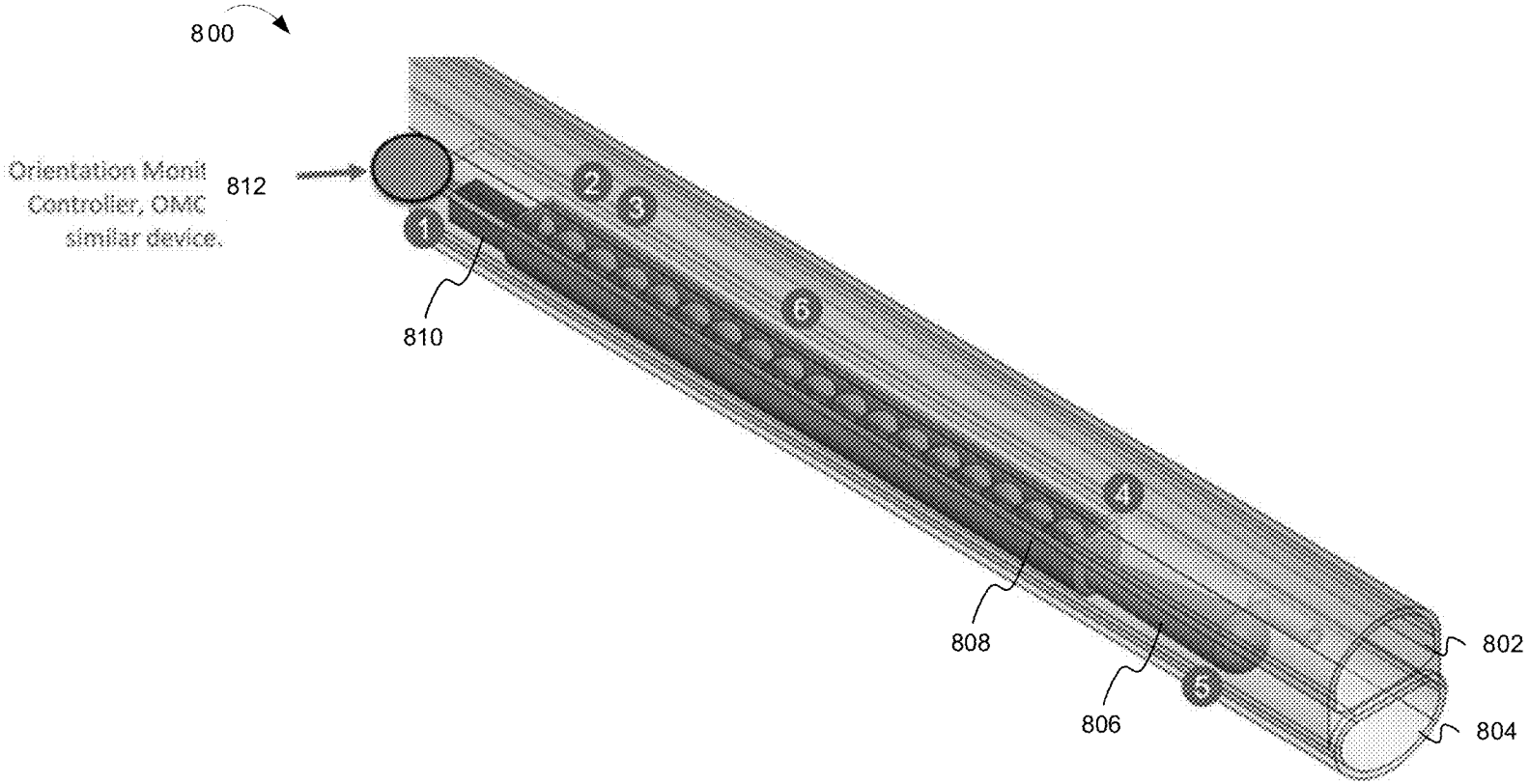
FIG. 8 is a perspective view of a DOWS assembly including a controller and sensors for orienting DOWS devices.

FIG. 8 is a perspective view of a DOWS assembly including a controller and sensors for orienting DOWS devices. The DOWS assembly 800 may include a plurality of flow paths 802 and 804. The DOWS assembly 800 may include components for separating solids from phases of fluid in the flow path 804. Hence, a DOWS assembly 800 may comprise one or more DOWSS assemblies or components thereof. The components may include a Hydro cyclone 806 configured to process fluid flowing through the flow path 804. The Hydro cyclone 806 may spin solids out of the fluid and deposit them in the conveyor 808. The conveyor 808_may include an auger or other suitable device configured to convey the solids to a receptacle 810.

The DOWS assembly 800 may include a controller 812 and sensors configured to detect and modify orientation of one or more components of the DOWS assembly 800. The sensors may be the placed at any suitable location. For example, one or more sensors may be coupled with any of the components in the DOWS assembly 800. One or more actuators may be coupled with each of the components of the DOWS assembly. In some implementations, the sensors may indicate an orientation of one or more components. In response, the controller 812 may determine that one or more components are properly oriented (such as within a range of orientations that result in acceptable performance) or may determine that one or more components may need to be reoriented. In turn, the controller 812 may reorient one or more components by operating the actuators. One or more devices my exhibit acceptable performance at one or more of the following orientations (relative to gravity): +/−90-degrees, Less than +/−90-degrees, Less than +/−65-degrees, Less than +/−45-degrees (angle of repose of earth), Less than +/−45-degrees (angle of repose of or wet sand), Less than +/−34-degrees (angle of repose of or dry sand), Less than +/−30-degrees (higher angle of repose of or water-filled sand), Less than +/−15-degrees (angle of repose of or wet excavated clay), Less than +/−15-degrees (lower angle of repose of or water-filled sand), Less than +/−10-degrees, Less than +/−7-degrees, Less than +/−5-degrees, Less than +/−2-degrees. Hence, the controller 812 may detect that a device is outside of one of these ranges and perform operations that cause the device to move back into such a range. The controller 812 also may detect that a device is within one of these ranges (so there is no need to move the device).

Figure 9:
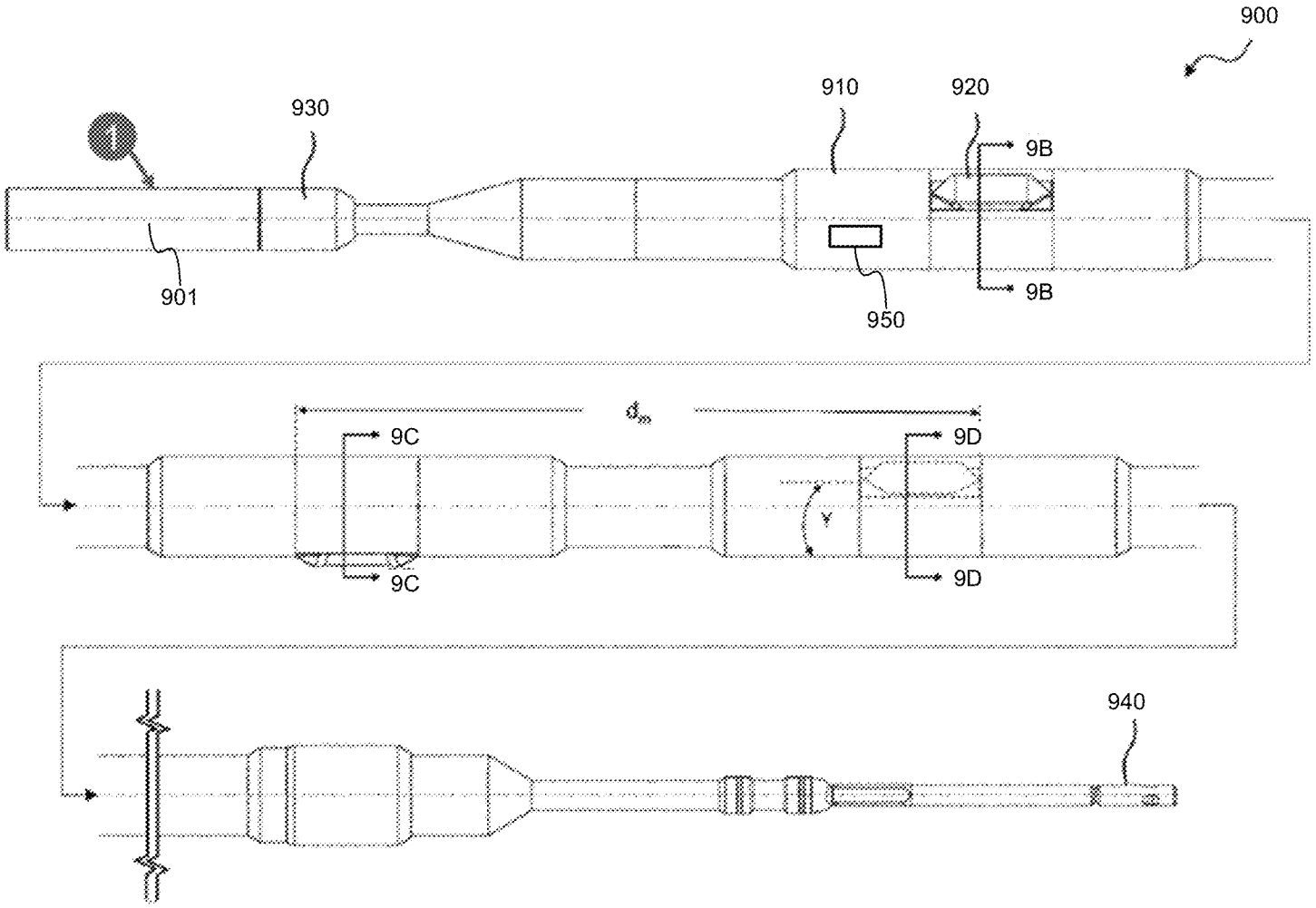
FIG. 9 is a perspective view of a downhole rotation tool including a controller for determining orientation of the tool.

FIG. 9 is a perspective view of a downhole rotation tool including a controller for determining orientation of the tool. The rotation tool 900 may be used for installing components of a DOWS system (such as a DOWS assembly or other device). The rotation tool 900 may include an orienting key 920 configured to engage with a profile (such as in a tubular into which the rotation tool 900 has been inserted) to rotate the rotation tool 900 to a particular orientation (such as an orientation that will enable the rotation tool 900 to mate with another device). The rotation tool 900 may include bearings that enable the rotation tool 900 to rotate about an axis 901. The rotation tool 900 also may include a controller 950 configured to monitor and report orientation of the tool. For example, the controller 950 may include one or more components configured to determine an orientation of the rotation tool 900. The controller 950 also may operate in concert with external sensors located anywhere on the rotation tool 900. The controller 950 also may include any suitable devices for communicating orientation information to one or more external systems. For example, the system may transmit fluid pulses to the surface, electrical signals to the surface, etc. The rotation tool 900 may provide the rotation/orientation while the position/orientation may be transmitted to surface via the one or more completion systems or components. As an example, the cable used to power the ESP and/or DOWS may transmit the actual orientation/direction/etc. information to the surface before/during/after the rotation tool's (900) use.

During operation, an operator or control system may receive information indicating an orientation of the rotation tool 900 (and therefore an orientation of the key 920). Based on the orientation information, the operator or control system may continue or cease rotation of the rotation tool 900 to engage the rotation tool 900 with the profile. Additionally, the interface component 940 may engage with another tool or device (such as a DOWS assembly). Therefore, the operator or control system may further utilize the orientation information to ensure the interface component 940 is at an orientation suitable to connect with another device. The operator or control system also may utilize the orientation information to place a DOWS assembly (connected to the interface component 940) at an orientation suitable for acceptable performance of the devices included in the DOWS assembly.

Figure 10:
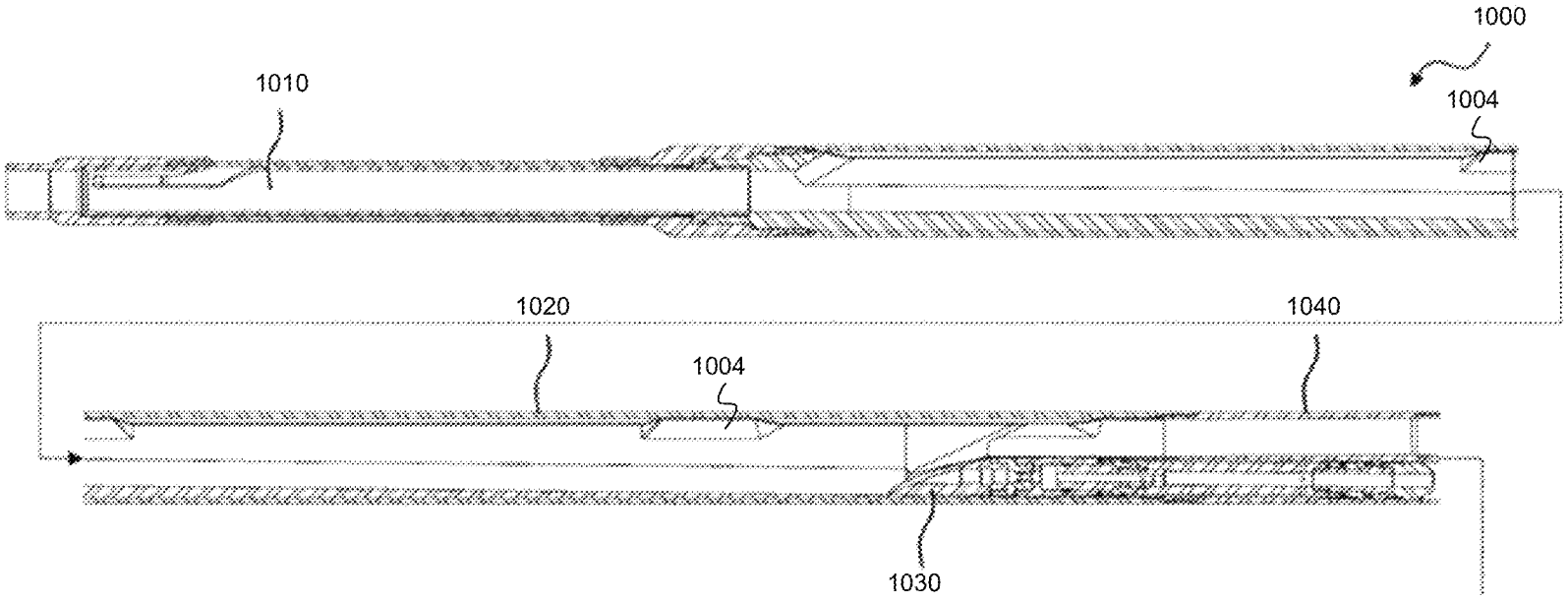
FIG. 10 is a sectional view of a device used in concert with the rotation tool.

FIG. 10 is a sectional view of a device used in concert with the rotation tool. The device 1000 may include one or more profiles 1004 configured to cause the rotation tool 900 to rotate about the axis 901 (when the rotation tool 900 is inserted inside the passageway 1010). The device 1000 may include a deflector 1030 configured to cause the rotation tool 900 (or any other suitable device) to deflect upward into the upper passageway 1040. The device 1000 and the deflector 1030 may be used above an ESP (not shown) in a well. In some implementations, the ESP may be disposed in the lower passageway below the deflector 1030. The deflector 1030 may enable tools to move to the upper passageway thereby avoiding the ESP. For example, the deflector 1030 may cause a wash tool, flushing tool, debris retrieval, device changing tool, or any other suitable tool to move into the upper passageway 1040. As noted, the rotational tool 900 may work in concert with the device 1000. Therefore, in some implementations, the controller 950 may facilitate operations involving both the rotation tool 900 and the device 1000. The controller 950 may be mounted on other devices and other locals. The controller 950 may be on the surface.

Some implementations of the controller include communication devices, orientation sensors, logic for determining orientation based on sensor information, and other components suitable to achieve the functionalities described herein. Any combination or permutation of the aspects described herein may be mixed and matched in any particular embodiment.

All the example OMCDs described herein may operate in concert with one or more other devices such as fluid separators, coalescers, perturbation devices, and others. Some novel combinations may not be explicitly shown in the drawings but are with the scope of this disclosure. For example, an OMCD, which may monitor and modify orientation of DOWS system devices, may be used with devices such as a flow pipes, solids removers, coalescers, perturbation devices, and other devices.

Figure 11:
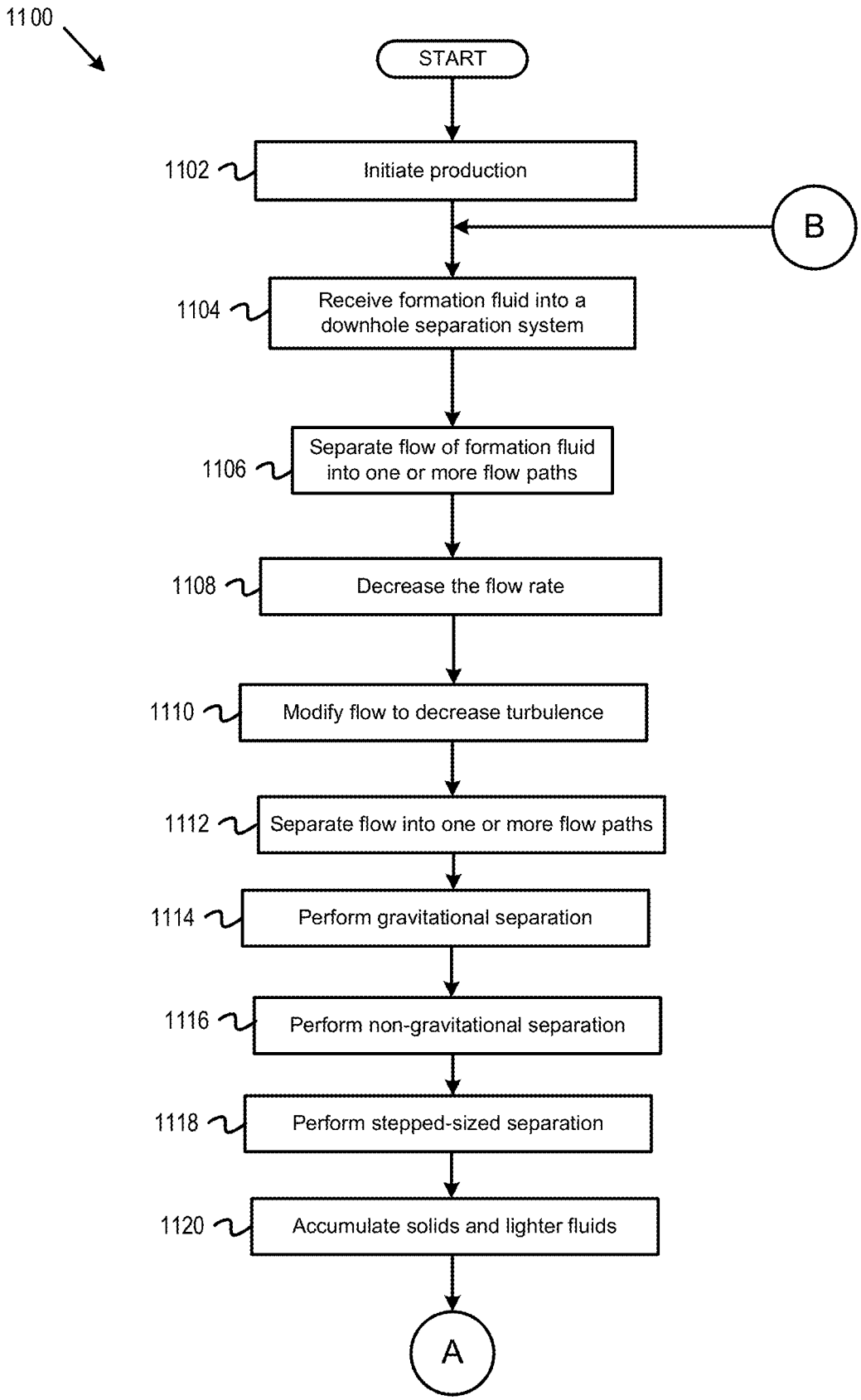
FIGS. 11-12 include a flowchart of example operations for downhole fluid and solid separation, according to some implementations.
Figure 12:
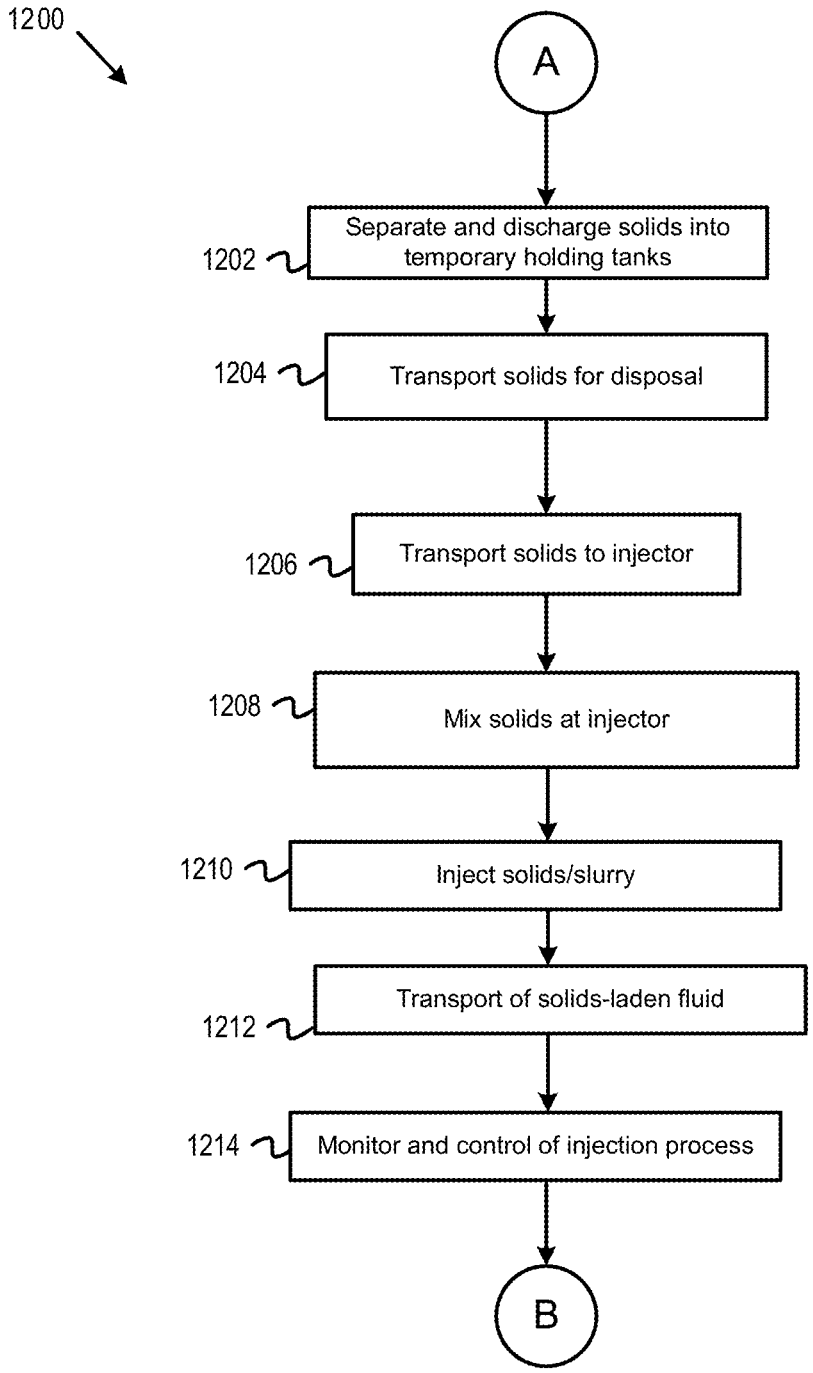

Example operations are now described. FIGS. 11-12 include a flowchart of example operations for downhole fluid and solid separation, according to some implementations.

At block 1102, production is initiated. For example, with reference to FIGS. 2-3, production may be initiated by the formation fluid 218 entering the main bore 202 and/or the lateral bore 204.

At block 1104, formation fluid is received into a downhole separation system. For example, with reference to FIGS. 2-3, the formation fluid 218 may be received into the separation system 224.

At block 1106, flow of formation fluid is separated into one or more flow paths. For example, with reference to FIGS. 2-3, the formation fluid 218 may flow into the fluid separator 296, wherein most or at least a majority of the production fluid 214 may separate into a flow above the separator 301, while most or at least a majority of the nonproduction fluid with sediment 394 may separate into a separate flow below the separator 301. Accordingly, if the formation fluid is at least partially segregated into oil-cut and water-cut, example implementations may take advantage of such a segregation to separate these fluids into two flow paths. Lower-density (oil-cut) fluids may flow through a top flow path. Higher-density (water-cut) may flow through a bottom flow path.

At block 1108, the flow rate is decreased. For example, with reference to FIG. 3, the formation fluid 218 moves from a smaller to a larger diameter of the tubing 387. This may decrease the velocity of the flow of the formation fluid 218—which allows the separation. In particular, most or at least a majority of the production fluid 214 may separate into a flow above the separator 301, while most or at least a majority of the nonproduction fluid with sediment 394 may separate into a separate flow below the separator 301. This allows most of the sediment to be captured in the lower portion of the tubing 387 (below the separator 301). Accordingly, example implementations may reduce flow from a high-turbulent flow to a slower, less turbulent flow. Example implementations may provide more flow area (an increased pipe inner diameter, increased wellbore size, multilateral wellbore for settling ponds, distributing flow, etc.). Example implementations may also provide more time (start and stop flow, slow pumping action, etc.)

At block 1110, flow is modified to decrease turbulence. For example, example implementations may also destabilize turbulence and reduce flow from a turbulent flow to a laminar flow (or transitional flow) by one or means (including those mentioned above).

At block 1112, flow is separated into one or more flow paths. For example, with reference to FIG. 3, the formation fluid 218 may be separated into one or more flow paths via the fluid separator 396. Such separation may be applicable to different flows (e.g., formation fluids, oil-cut, water-cut, gas, liquid, liquid-gas, slurries (solids-laden fluids, production fluids, fluids to be disposed, fluids to be injected, etc.).

At block 1114, gravitational separation is performed. For example, with reference to FIG. 3, the fluid separator 396 may comprise a gravity-based separation that includes the separator 301.

At block 1116, non-gravitational separation is performed. For example, with reference to FIG. 3, the formation fluid 218 may be separated using different types of non-gravitational operations.

At block 1118, stepped-sized separation is performed. For example, with reference to FIG. 3, the sediment separators 390A-390N may separate the sediment 394 from the nonproduction fluid 116. For example, the sediment separators 390A-390N may separate out the largest or densest solids first, then separate out the next largest or densest solids, etc. Example implementations may include allowing for settling and separation of solids to separate from fluid stream(s). Additionally, example implementations may allow time for the largest and/or densest solids to settle out from fluids. Example implementations may also allow lower flow rates to assist with the separation. Example implementations may use the sediment separators 390A-390N to allow the largest and/or densest solids to settle out, accumulate and be trapped. Example implementations may include allowing time for lighter fluids and gases to begin to segregate and separate from heavier fluids. Example implementations may include means, methods, and devices to subject one or more fluids to one or more force, acceleration, path (e.g., tortuous path, etc.), velocity, pressure, restriction (e.g., screen opening(s), screen size, nozzle, etc.), time, impulse, change in one or more of the above including step change, gradual change, etc. Example implementations may separate based on at least one of density, size, shape, surface tension, molecular makeup, other chemical, physical, molecular, electron properties, etc.

At block 1120, solids and lighter fluids are accumulated. For example, with reference to FIG. 3, the different sediment separators 390A-390N may accumulate the Operations of the flowchart 1100 continue at transition point A, which continues at transition point A of FIG. 12. From transition point A of FIG. 12, operations continue at block 1202.

At block 1202, solids are separated and discharged into temporary holding tanks. For example, with reference to FIGS. 2-3, the different sediment separators 390A-390N may include temporary holding tanks for storing the separated out solids. Example implementations may include utilizing an auger, drag chain, an inclined plane, a jetting device, etc. to keep the solids or slurry from accumulating at the discharge end of the solid separation device which may cause the device to plug and become inoperable.

At block 1204, solids are transported for disposal. For example, with reference to FIG. 3, these different collections of the sediment by the different sediment separators 390 may be injected into a same or different line or tubing for disposal. As shown, the sediment injector(s) 399 are coupled to receive the sediment collected by the different sediment separators 390.

At block 1206, solids are transported to an injector. For example, with reference to FIGS. 2-3, the sediment may be transported to the sediment injectors 399.

At block 1208, solids may be mixed at the injector. For example, with reference to FIG. 3, the sediment 395 may be mixed at the sediment injector 399. For example, the sediment 395 may be mixed with fluid (such as production fluid, nonproduction fluid, etc.). In some implementations, one or more types of mixers may be used. For example, a mechanical mixer, a fluid-type mixer, etc. may be used to mix the sediment 395 with fluid. In some implementations, solids may be stored in or near the injector 399 so that mixing may progress smoothly or consistently at a defined rate. For example, the solids may be stored in an enclosed tank, gravity-fed tank, auger-fed tank, etc.

At block 1210, solids (or slurry) are injected. For example, with reference to FIGS. 2-3, the sediment injectors 399 may deliver the sediment to a different downhole location (such as a different lateral well, a thief zone (having a high porosity, high permeability downhole zone that may include a low pressure), etc.). In some implementations, sediment may be disposed to different locations depending on their size. For example, for sediment having a size greater than X, such solids may be delivered to the surface of the multilateral well for disposal. For sediment having a size less than X but greater than Y, such sediment may be disposed in a first downhole location (such as a thief zone). For the remaining sediment that have a size less than Y, such solids may be disposed in a second downhole location (such as a lateral well).

At block 1212, solids-laden fluid is transported. For example, with reference to FIGS. 2-3, the sediment injector(s) 399 may dispose of these sediments by injecting them into a tubing for delivery to the surface of the multilateral well. For example, the sediment may be delivered to the surface using the production tubing or a separate tubing. If the production tubing is used, the solids may be included with the production fluid that is being delivered to the surface. In such implementations, separation operations may be performed at the surface to separate out the solids from the production fluid 214. Accordingly, if sediment is being included with the production fluid 214 being delivered to the surface, the production fluid 214 may be delivered to surface equipment that provides for separation of the sediment. Alternatively, during the time when the sediment is not being included with the production fluid 214, the production fluid 214 may be delivered to different surface equipment that does not include such separation of sediment.

In some implementations, the sediment injectors 399 may inject the solids or slurry into a string or tubular (e.g., a production tubing). Timing of the injection may be coordinated with production of production fluid. For example, a pump may switch between pumping (in the production tubing) production fluid to the solid-laden fluid. Example implementations may include communications to the surface regarding the switching, the volume of the solids, fluids, slurry to be pumped, how much has been pumped, how much remains to be pumped, etc. Additionally, some implementations may enable communication from the surface to downhole to control and override the switching.

At block 1214, injection process is monitored and controlled. For example, with reference to FIGS. 2-3, controllers may be coupled to the sediment injectors 399 for monitoring and controlling the injection and disposal of the sediment (either to the surface of the multilateral wall or to a disposal location downhole).

Operations of the flowchart 1200 continue at transition point B, which continues at transition point B of FIG. 11. From transition point B of FIG. 11, operations return to operations at block 1104.

Figure 13:
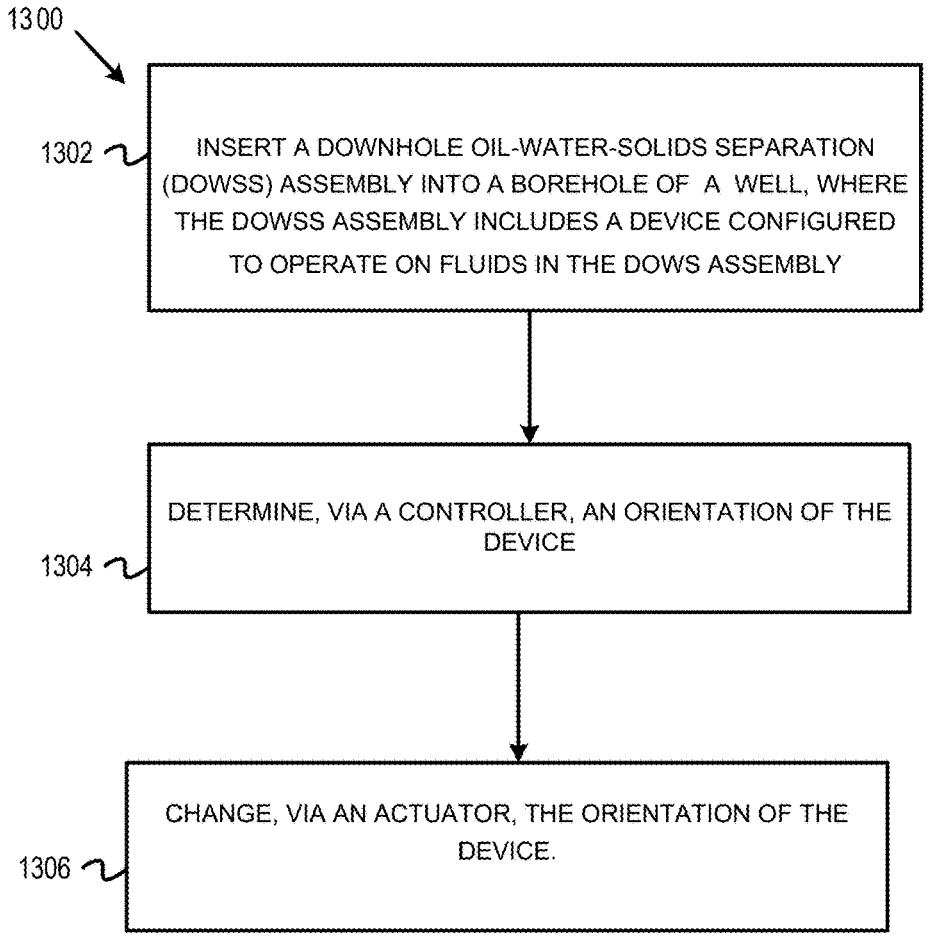
FIG. 13 is a flow describing operations for utilizing devices for determining and changing orientation of DOWS devices.

FIG. 13 is a flow describing operations for utilizing devices for determining and changing orientation of DOWS devices. At block 1302, a downhole oil-water separation (DOWS) assembly may be inserted into a borehole of a multilateral well, the DOWS assembly including a DOWS device configured to operate on fluids in the DOWS assembly. At block 1304, a controller may determine an orientation of the DOWS device. At block 1306, an actuator may change the orientation of the DOWS device.

Example Wells

All the example controllers, sensors, and devices described herein may operate in concert with one or more other devices such as fluid separators, coalescers, perturbation devices, and others. Some novel combinations may not be explicitly shown in the drawings but are with the scope of this disclosure. For example, a leveler, which may inhibit phase separation of formation fluid or achieve other aspects of fluid flow, may be used with devices such as a flow pipes, solids removers, coalescers, perturbation devices, and other devices.

Example implementations may be performed in different Technology Advancement of Multilaterals (TAML) Level wells. In particular, multilateral wells are characterized according to definitions established in 1997 during a Technology Advancement of Multilaterals (TAML) Forum held in Aberdeen. These standards classify junctions as TAML Level 1, 2, 3, 4, 5, or 6 based on mechanical complexity, connectivity, and hydraulic isolation. The ascending order of these levels reflects the increasing mechanical and pressure capability of the junction. Consequently, cost, complexity, and risk also generally increase at the higher TAML levels. However, other considerations of the well design also influence the overall complexity of the well—for example, a TAML Level 2 well with an advanced intelligent completion can be more complex and costly than a TAML Level 5 well with a simpler completion system.

In a TAML 1 well, the main bore, lateral, and junction are uncased. This basic lateral is designed to enhance reservoir drainage from consolidated formations. It has the advantage of low drilling and completion costs, but the open hole junction makes reentry into the lateral wellbore and control of flow from the lateral impossible.

Wells that have cased and cemented main bores and open hole laterals are designated TAML Level 2. A cemented main bore significantly reduces the risk of wellbore collapse and provides isolation between laterals. By placing sliding sleeves and packers in the main bore, operators can produce the bores singly or in commingle production.

Placing a liner in the lateral and mechanically connecting it to the cased and cemented main bore results in a TAML Level 3 well. A liner is a string of casing that does not extend to the surface but is anchored or suspended inside a previously run casing string. This TAML Level 3 well includes a lateral that is cased but not cemented at the junction. It is a relatively low-cost option that includes reentry capabilities and a lateral that is better supported than that of Levels 1 and 2. Using sliding sleeves and packer plugs, operators can produce the bores singly or in commingle production. A TAML Level 3 junction does not provide hydraulic isolation, and its use is restricted to consolidated formations.

TAML Level 4 junctions are applicable in both consolidated and unconsolidated formations because both the lateral and the main bore are cased and cemented at the junction. The junction provides full bore access to the lateral, and mechanical support is supplied by the tubulars and cement. However, because the cement can only withstand limited differential pressure, the junction does not provide hydraulic isolation.

TAML Level 5 wells do provide hydraulic isolation at the junction because pressure integrity is provided by the completion, which includes production tubing connecting a packer in the main wellbore above the junction and a packer in the lateral wellbore. Because hydraulic isolation and support are provided by the completion hardware, the junction may be a TAML Level 2, 3, or 4 before the Level 5 completion is installed. TAML Level 6 wells also provide hydraulic isolation at the junction. A well at this level differs from a TAML Level 5 well in that pressure integrity is provided by the main wellbore casing and a cemented or uncemented liner in the lateral. The cost and complexity of creating a single-metal-element dual-bore casing junction downhole has prevented TAML Level 6 wells from being developed. As of today, the category exists as a result of early experiments. Because multilateral wells that have higher TAML designations are generally more complex, they are more costly, and their configurations are more flexible. As they do with multilateral geometry, engineers choose a TAML level junction based primarily on reservoir characteristics, costs, and function.

The ability to reenter the lateral for well intervention operations is another multilateral well design consideration. Because it is a directionally drilled section that has no junction, the lower lateral is almost always easily accessed using standard intervention methods. Operators must make an economics-based decision during the well planning stage to include junctions that allow lateral access after pulling the upper completion, through-tubing access, junctions that can be adopted to allow access after installation or junctions through which no access is possible to main bore, lateral, or both. If the well includes more than one lateral, a selective through-tubing access system would need to be considered. The decision to deploy lateral junctions that allow full bore or restricted access is a function of the overall well design. Engineers usually opt for full bore access if a packer is to be placed below the junction or if an artificial lift system must be located near the lower lateral. In addition, based on their knowledge of the reservoir, operators may require full bore access to perform perforating, stimulation, logging, water shutoff, gravel packing, cleanout, and other remedial operations. Full bore access can be adapted to all TAML level junctions but must be specified before installation; some commercially available junctions allow no access or only restricted access to either the lateral or the main bore and cannot be adapted after installation.

The decision to use a multilateral well system and what type to use are the result of cost benefit analyses. In general, the less-complex junctions present operators with lower risks and costs. But risk mitigation and cost savings must be balanced against individual well and field development expectations. In low-value reservoirs, a simple open hole lateral that has no reentry capability may increase ultimate reserve recovery or accelerate production while having little impact on overall drilling and completion costs. In high-value deepwater plays, installing a hydraulically sealed TAML Level 5 or 6 junction can drive total well costs into millions of dollars and still be a good investment because it may save drilling another well with a complex and tortuous trajectory, preserve a well slot on an existing production platform, or eliminate the need entirely to procure and install additional subsea infrastructure.

In implementations, a multilateral well is drilled and completed with a TAML Level 4 junction. The junction includes a pump and a fluid separator. The pump includes any pump capable of drawing in fluid through the pump intake, pressurizing it, and lifting it to the surface such as an electrical submersible pump, sucker-rod and pump jack, progressive cavity pump, gas lift and intermittent gas lift, reciprocating and jet hydraulic pumping systems, etc. The fluid separator and the pump can be above, at, or below the junction. The upper completion includes a retrievable electrical submersible pump packer while the lower completion has an orientation liner hanger or other orientation device.

While the aspects of the disclosure are described with reference to various implementations and exploitations, it will be understood that these aspects are illustrative and that the scope of the claims is not limited to them. Many variations, modifications, additions, and improvements are possible. Plural instances may be provided for components, operations or structures described herein as a single instance. Finally, boundaries between various components, operations and data stores are somewhat arbitrary, and particular operations are illustrated in the context of specific illustrative configurations. Other allocations of functionality are envisioned and may fall within the scope of the disclosure. In general, structures and functionality presented as separate components in the example configurations may be implemented as a combined structure or component. Similarly, structures and functionality presented as a single component may be implemented as separate components. These and other variations, modifications, additions, and improvements may fall within the scope of the disclosure.

In some implementations, a mechanical junction (not to be confused with the earthen junction of 2 earthen wellbores) may comprise a junction with a monolithic Y-Block. In some implementations, a monolithic Y-Block may provide for more robust connections to the other components of a junction assembly (i.e., main bore leg, lateral leg, tank, etc.).

Figure 14:
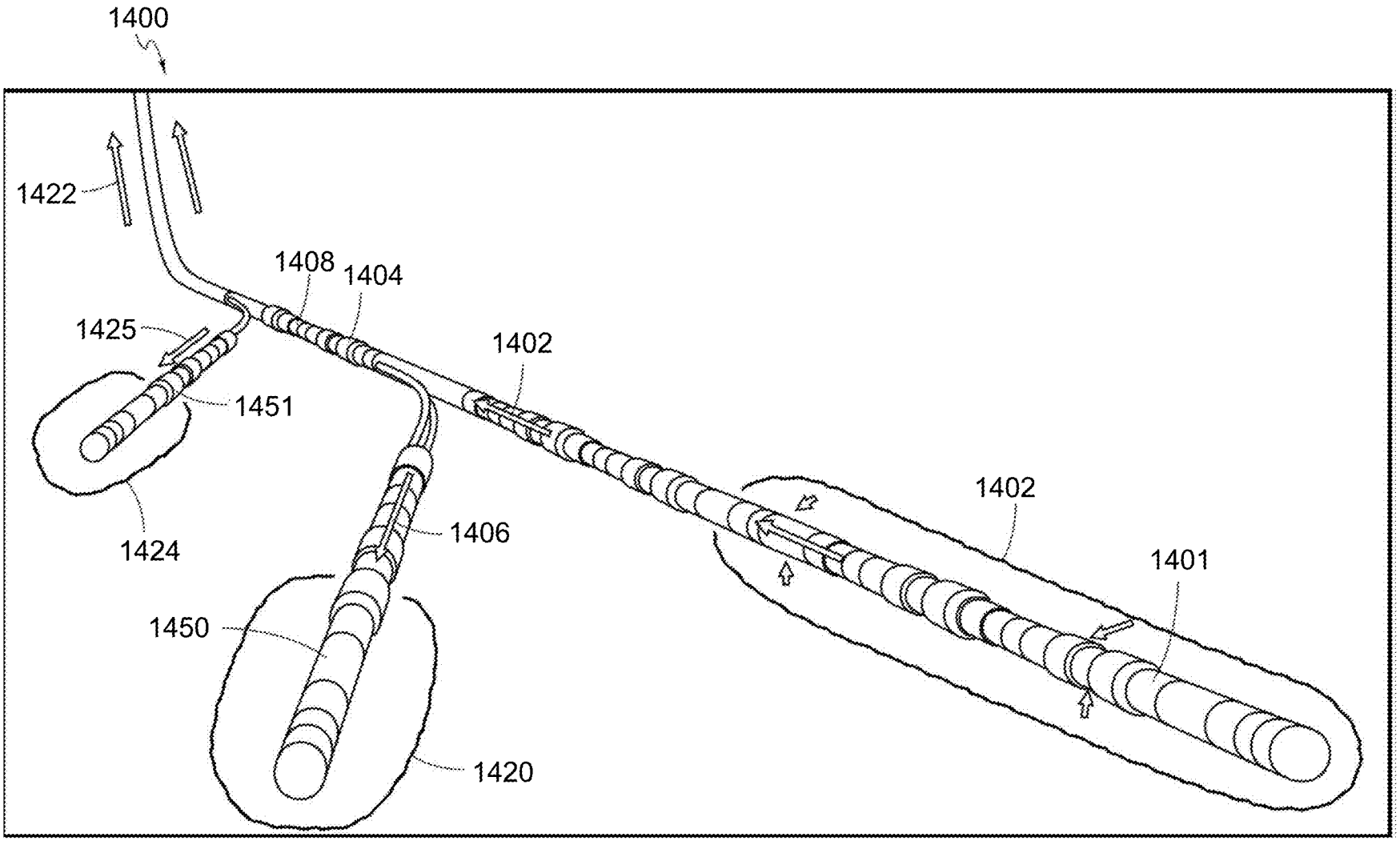
FIG. 14 is a perspective view of an example of a Level 5 (mechanical) junction assembly for use with a downhole oil, water, and solids separator system, according to some implementations.

To illustrate, FIG. 14 is a perspective view of an example of a Level 5 (mechanical) junction assembly for use with a downhole oil, water, and solids separator system, according to some implementations. FIG. 14 depicts a system 1400 having a multilateral well that includes a main bore 1401, a lateral bore 1450, and a lateral bore 1451. Formation fluid 1402 from the surrounding subsurface formation enters the main bore 1401. The formation fluid 1402 is transported through the main bore 1401 uphole to a level 5 monolithic Y-block 1404 and into a DOWSS 1408.

The DOWSS 1408 may process the formation fluid 1402 to separate out nonproduction fluid 1406 from production fluid 1422. The DOWSS 1408 may also process the formation fluid 1402 to separate sediment from at least one of the nonproduction fluid 1406 or the production fluid 1422. The DOWSS 1408 may transport the nonproduction fluid 1406 into the lateral bore 1450 for disposal in a disposal zone 1420 for the nonproduction fluid 1406 in the subsurface formation around the lateral bore 1450. The DOWSS 1408 may also transport sediment 1425 into the lateral bore 1451 for disposal in a disposal zone 1424 for the sediment 1425 in the subsurface formation around the lateral bore 1451. The DOWSS 1408 may also transport the production fluid 1422 and sediment 1425 to a surface of the multilateral well. Accordingly, in this example, the sediment may be disposed downhole into a highly permeable zone downhole and/or may be transported to the surface of the multilateral well.

Figure 15:
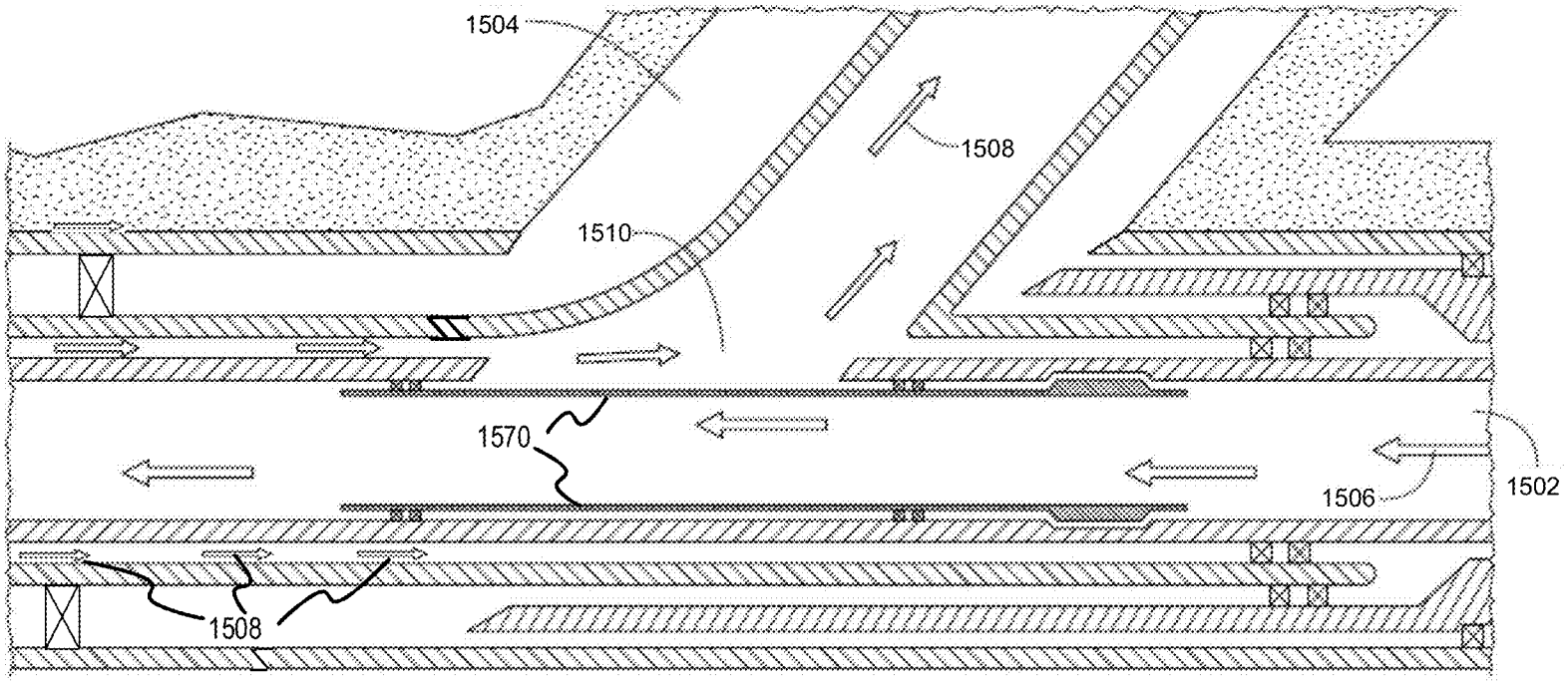
FIG. 15 is a cross-sectional view of an example of a Level 5 junction assembly for use with a downhole oil, water, and solids separator system, according to some implementations.

FIG. 15 is a cross-sectional view of an example of a Level 5 junction assembly for use with a downhole oil, water, and solids separator system, according to some implementations. In this implementation, a main bore junction 1510 is used to provide a main bore 1502 for large tools to be passed through, or landed, in the y-block and/or main bore area of the junction 1510. A lateral bore 1504 is formed off the main bore 1502 at the junction 1510. In the example shown, an isolation sleeve 1570 may be landed in the junction. As shown, the isolation sleeve 1570 may provide pressure isolation between the formation fluids 1506 and the nonproduction fluids 1508. This main bore junction 1510 may be used with a variety of different Downhole Oil Water Separator Systems (DOWSS) and/or components including the DOWSS and/or its components disclosed within herein. The main bore junction 1510 may have a main bore leg inside diameter (ID) of 30% the outer diameter (OD) of the Junction's Y-Block. The main bore leg's ID may be 40% the OD of the Junction's Y-Block. The main bore leg's ID may be 50%, 53%, 55%, 60%, 67% or more of the Junction's Y-Block OD.

Figure 16A:
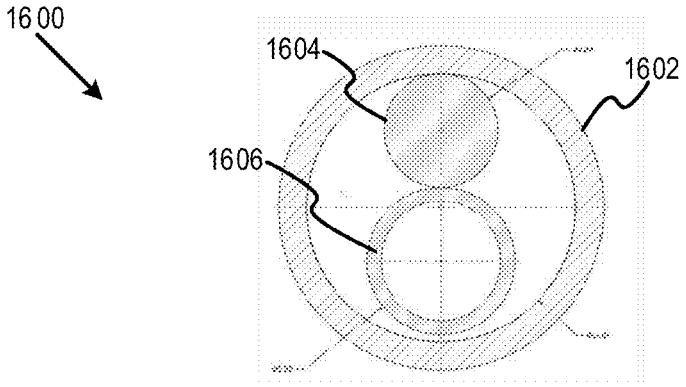
FIGS. 16A-16C are cross-sectional views of an example DOWSS positioned in a casing, according to some implementations.
Figure 16B:
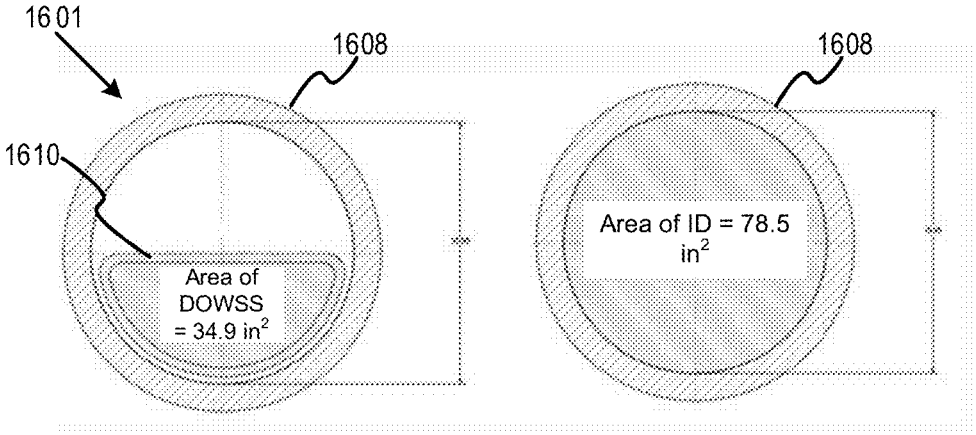
Figure 16C:
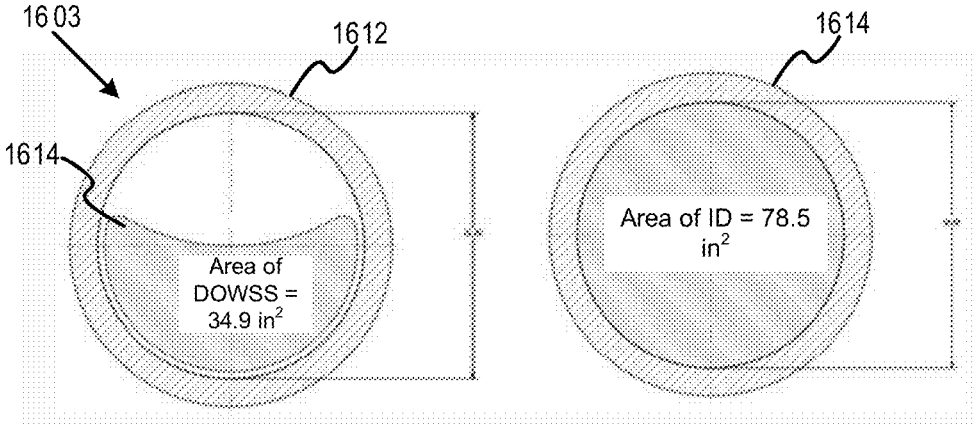

To help illustrate, FIGS. 16A-16C are cross-sectional views of an example DOWSS positioned in a casing, according to some implementations. FIG. 16A includes a DOWSS cross section view 1600 of a DOWSS 1606 in the inner bore of a casing 1602. As shown, the DOWSS 1606 and/or related equipment occupies approximately 55% of the inner diameter of the casing 1602. Accordingly, the remaining diameter may allow for a tool 1604 or to pass by the DOWSS. FIG. 16B includes a DOWSS cross section view 1601 of a DOWSS 1610 in the inner bore of a casing 1608. As shown in this implementation, the inner bore of the casing 1608 is approximately 78.5 square inches and the DOWSS 1610 occupies about 34.9 square inches, or approximately 44% of the flow area. Thus, the remaining area may remain open for tools to pass by the DOWSS 1610 for cleaning, servicing, parts replacement, etc. on the DOWSS 1610, related equipment, or other equipment/areas past the DOWSS 1610 in a well. The DOWSS 1610 may occupy any suitable space of the inner bore of the casing 1608. FIG. 16C includes a DOWSS cross section view 1603 of a DOWSS 1614 in the inner bore of a casing 1612. Similarly to FIG. 16B, the inner bore of the casing 1612 is approximately 78.5 square inches and the DOWSS 1614 occupies about 34.9 square inches, or approximately 44% of the flow area. Thus, the remaining area may remain open for tools to pass by the DOWSS 1614 for cleaning, servicing, parts replacement, etc. on the DOWSS 1614, related equipment, or other equipment/areas past the DOWSS 1614 in a well. In some implementations, the outer profile of the DOWSS 1614 may be shaped to provide functions such as support tools that pass over the DOWSS 1614, provide a sealing surface for service tools to seal against, provide features for the service tools to attach themselves to (such as to replace components, flush debris, lubricate one or more components, etc.), etc.

Figure 17:
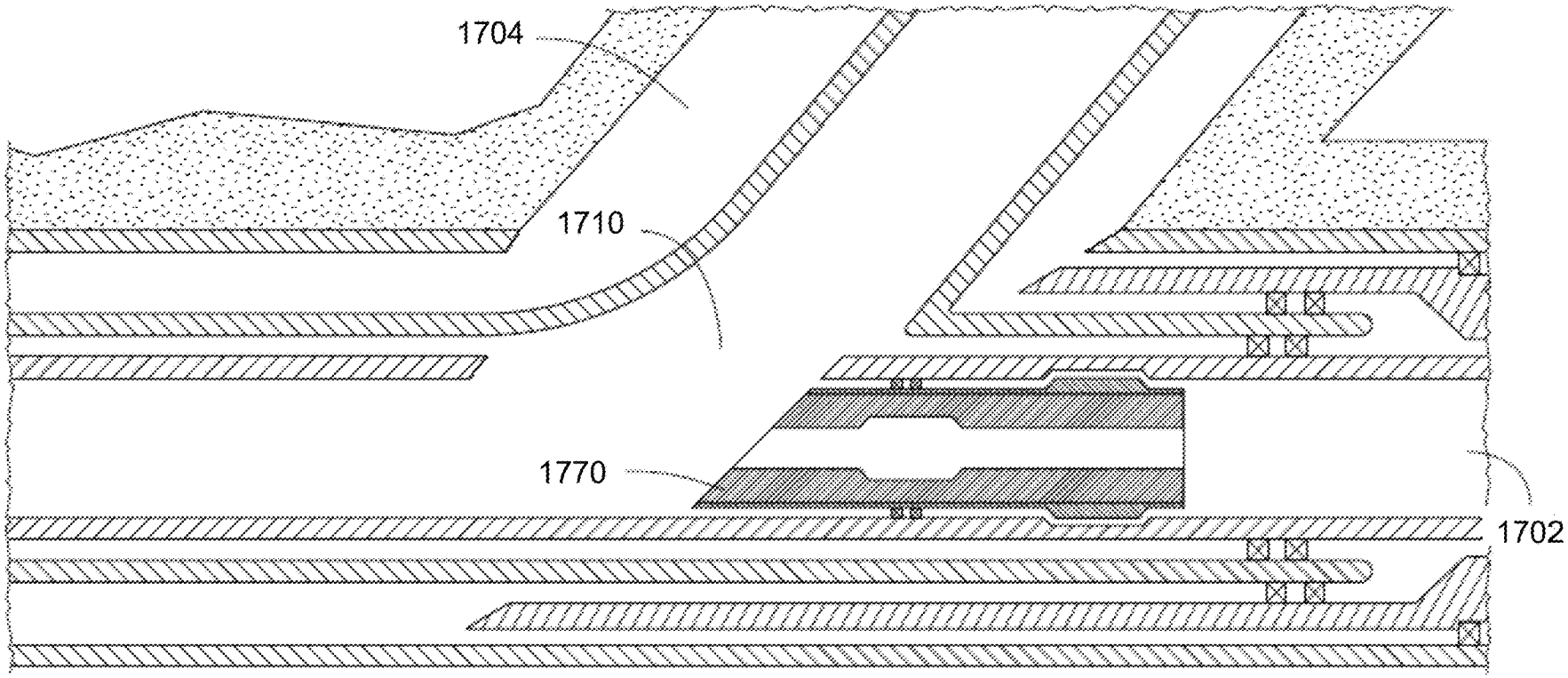
FIG. 17 is a cross-sectional view of an implementation where the isolation sleeve can be shifted out of the way (or retrieved) and a deflection device installed to aid in deflecting one or more tools or devices out into a lateral bore, according to some implementations.

FIG. 17 is a cross-sectional view of an implementation where the isolation sleeve can be shifted out of the way (or retrieved) and a deflection device installed to aid in deflecting one or more tools or devices out into a lateral bore, according to some implementations. FIG. 17 depicts a main bore 1702 and a lateral bore 1704 that is formed off the main bore 1702 at the junction 1710. An isolation sleeve 1770 may be shifted out of the way (or retrieved) to allow for a deflection device to be installed to aid in deflecting one or more tools or devices out into the lateral bore 1704.

Figure 18:
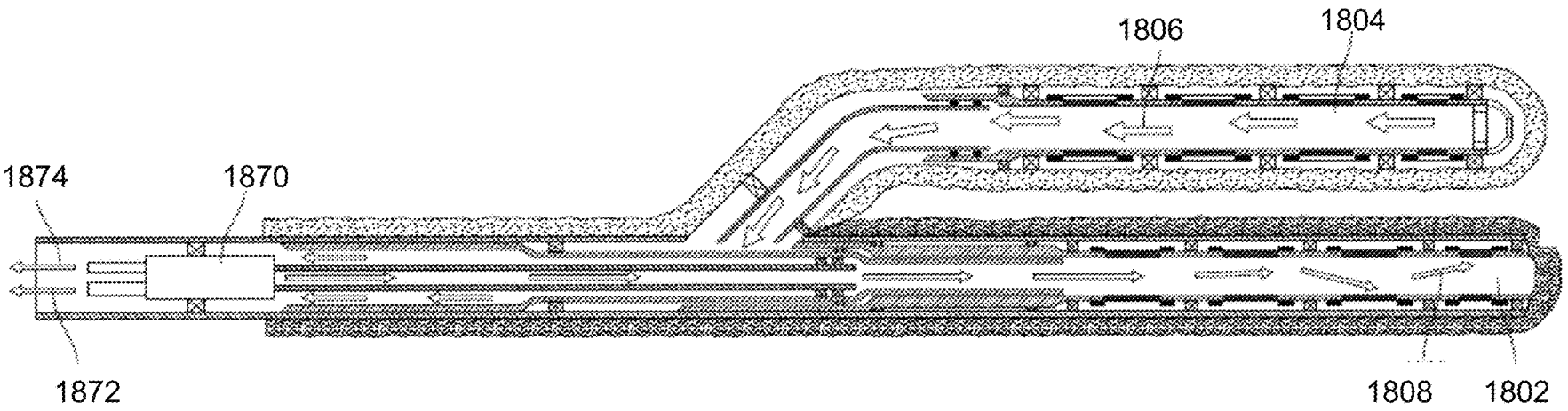
FIG. 18 is a cross-sectional view of a multilateral tool implementation of one or more DOWSS implementations with a non-Level 5 junction, according to some implementations.

FIG. 18 is a cross-sectional view of a multilateral tool implementation of one or more DOWSS implementations with a non-Level 5 junction, according to some implementations. In this example, the multilateral well is producing from a lateral bore 1804 (instead of the main bore 1802) so the earthen junction is not over-pressure by fluid being injected in its surroundings. Formation fluid 1806 is being produced from a subsurface formation surrounding the lateral bore 1804. A DOWSS 1870 may receive the formation fluid 1806 and separate the formation fluid 1806 into a nonproduction fluid 1808, a sediment 1872, and a production fluid 1874. As shown, the nonproduction fluid 1808 may be disposed of downhole by being transported into the main bore 1802 for disposal in the surrounding subsurface formation. The sediment 1872 may be disposed of downhole and/or transported to the surface of the multilateral well. The production fluid 1874 may be transported to the surface of the multilateral well.

The above examples of junctions are provided as non-limiting examples—as other type of junctions may be used. The placement of the DOWSS, the DOWSS components, the tubing/fluid paths are also non-limiting examples—as other placements, components, paths may be used. The terms "downhole" and "below" may or may not be considered equivalent depending on the type of wellbore. For example, "downhole" and "below" may be considered the same for vertical wellbores. However, "downhole" and "below" may be considered different for horizontal wellbores.

Example Subsea DOWSS (Downhole Oil Water Solids Separation)

Example implementations may include Subsea Oil Water Solids Separation (SOWSS). Example implementations may include disposal of solids, storage of water, and oil maybe subsea—on the seafloor or in storage wells or in storage vessels embedded in the seafloor.

Figure 19:
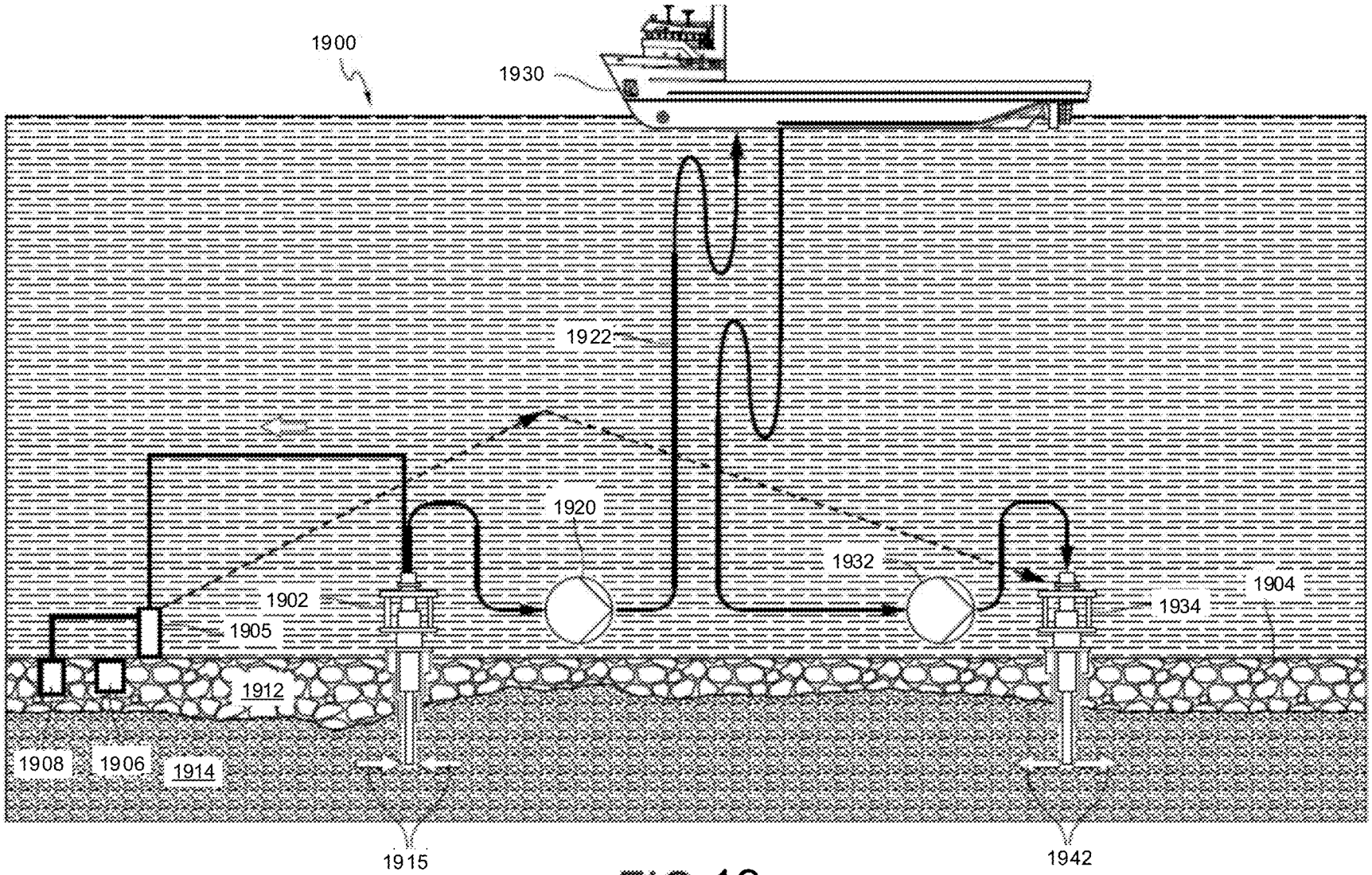
FIG. 19 is a perspective view of a first example subsea DOWSS, according to some implementations.

FIG. 19 is a perspective view of a first example subsea DOWSS, according to some implementations. FIG. 19 includes a subsea DOWSS 1900 that includes a subsea production well 1902 formed in a subsea surface 1904. The subsea production well 1902 may be formed through rock 1912 and a reservoir 1914. As described herein, production fluid (such as hydrocarbons 1915) and possibly nonproduction fluid, sediment, etc. may be transported from downhole to a surface of the subsea production well 1902.

In some implementations, this fluid transported to the surface of the subsea production well 1902 may be transported to a ship 1930 via a multiphase pump 1920 and risers 1922. The ship 1930 may include equipment to separate out nonproduction fluid (such as water) from the production fluid. The ship 1930 may also include storage for the production fluid. As shown, the nonproduction fluid (such as water) separated out from the production fluid by equipment of the ship 1930 may be transported down below to a subsea injection well 1934 via a water injection pump 1932. The water 1942 may be pumped downhole into the subsea injection well 1934. As shown, the water 1942 may be returned for storage in the reservoir 1914.

In some implementations, at least some of the fluid transmitted to the surface of the subsea production well 1902 may remain below (instead of being transported to the ship 1930). For example, after being transported to the surface, the fluid may be transported to a location 1905 at the subsea surface 1904 for processing, separating, pumping, etc. Then, the nonproduction fluid (separated out from this fluid) may be stored below the subsea surface 1904 at a location 1908. Additionally, the production fluid (separated out from this fluid) may be stored below the subsea surface 1904 at a location 1906. In some implementations (even though not shown), sediment (solids) separated out from this fluid may be stored at or under the subsea surface 1904.

Accordingly, fluid from the subsea production well 1902 may be pumped to subsea surface 1904 for processing, temporary storage, transport, water injection to maintain reservoir pressure, water flood from the subsea injection well 1934 to push hydrocarbons to the subsea production well 1902 and/or disposal.

In some implementations, the solids may be flowed to the sea floor and then injected into a disposal well (or other designated well). In some implementations, the solids, non-commercial fluids, a combination of both, etc. may be produced, separated, processed, stored, and then injected into the disposal well (or other designated well).

Figure 20:
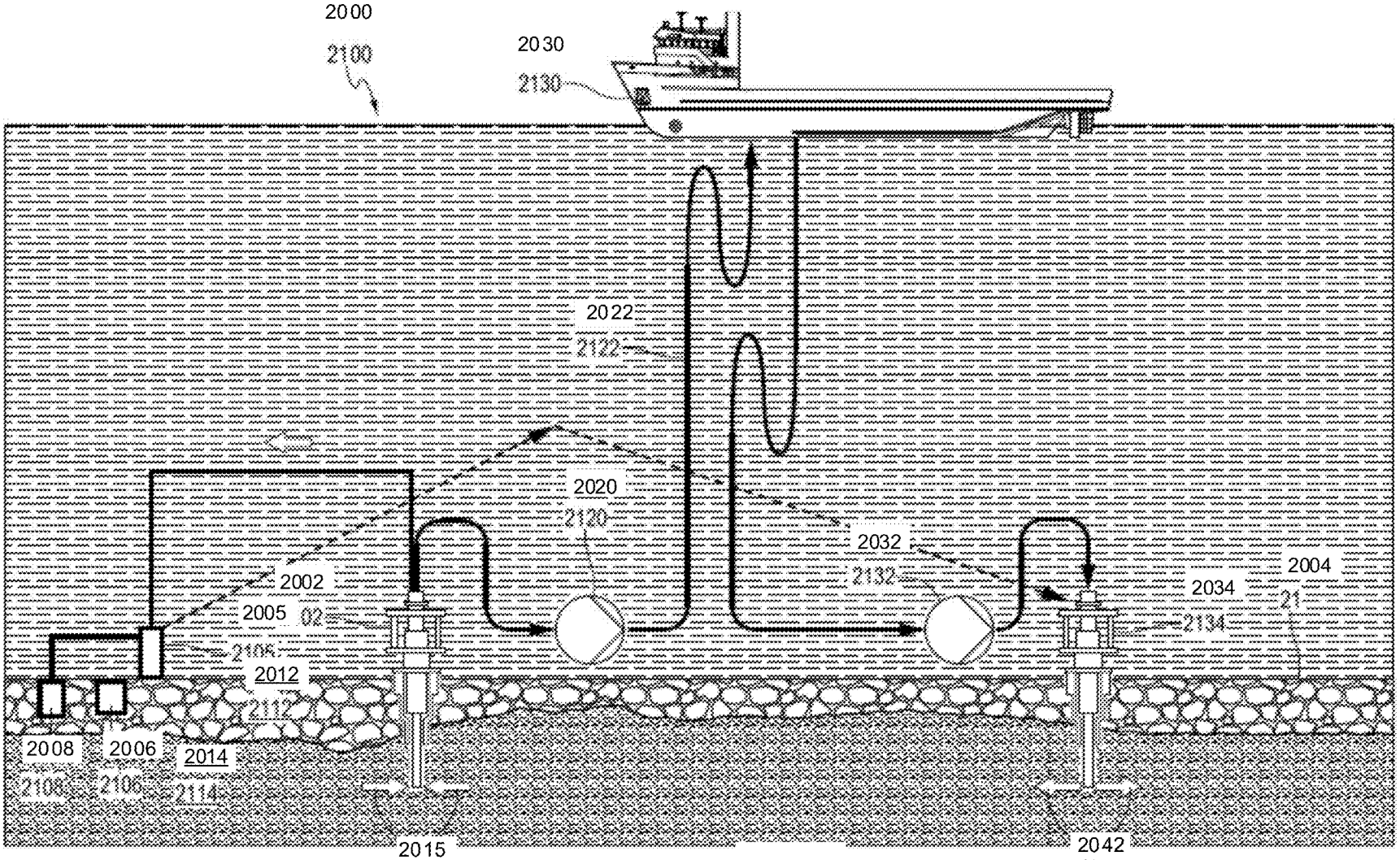
FIG. 20 is a perspective view of a second example subsea DOWSS, according to some implementations.

To illustrate, FIG. 20 is a perspective view of a second example subsea DOWSS, according to some implementations. Offshore drilling rigs (on occasion) inject used drilling mud into a disposal well. FIG. 20 includes a subsea DOWSS 2000 that includes a subsea disposal well 2034 used for injection of used drilling mud (solids (drill cuttings) 2042). The subsea DOWSS 2000 also includes a subsea production well 2002. As shown, the subsea disposal well 2034 and the subsea production well 2002 may be formed in a subsea surface 2004. The subsea disposal well 2034 and the subsea production well 2002 may be formed through rock 2012 and a reservoir 2014. As described herein, production fluid (such as hydrocarbons 2015) and possibly nonproduction fluid, sediment, etc. may be transported from downhole to a surface of the subsea production well 2002.

In some implementations, this fluid transported to the surface of the subsea production well 2002 may be transported to a ship 2030 via a multiphase pump 2020 and risers 2022. The ship 2030 may include equipment to separate out nonproduction fluid (such as water) from the production fluid. The ship 2030 may also include storage for the production fluid. As shown, the solids (drill cuttings) separated out from the production fluid by equipment of the ship 2030 may be transported down below to the subsea disposal well 2034 via a pump 2032. The solids (drill cuttings) 2042 may be pumped downhole into the subsea disposal well 2034 for storage in the reservoir 2014.

In some implementations, at least some of the fluid transmitted to the surface of the subsea production well 2002 may remain below (instead of being transported to the ship 2030). For example, after being transported to the surface, the fluid may be transported to a location 2005 at the subsea surface 2004 for processing, separating, pumping, etc. Then, the nonproduction fluid (separated out from this fluid) may be stored below the subsea surface 2004 at a location 2008. Additionally, the production fluid (separated out from this fluid) may be stored below the subsea surface 2004 at a location 2006. The solids (drill cuttings) separated out from this fluid may be stored downhole in the subsea disposal well 2034.

Figure 21:
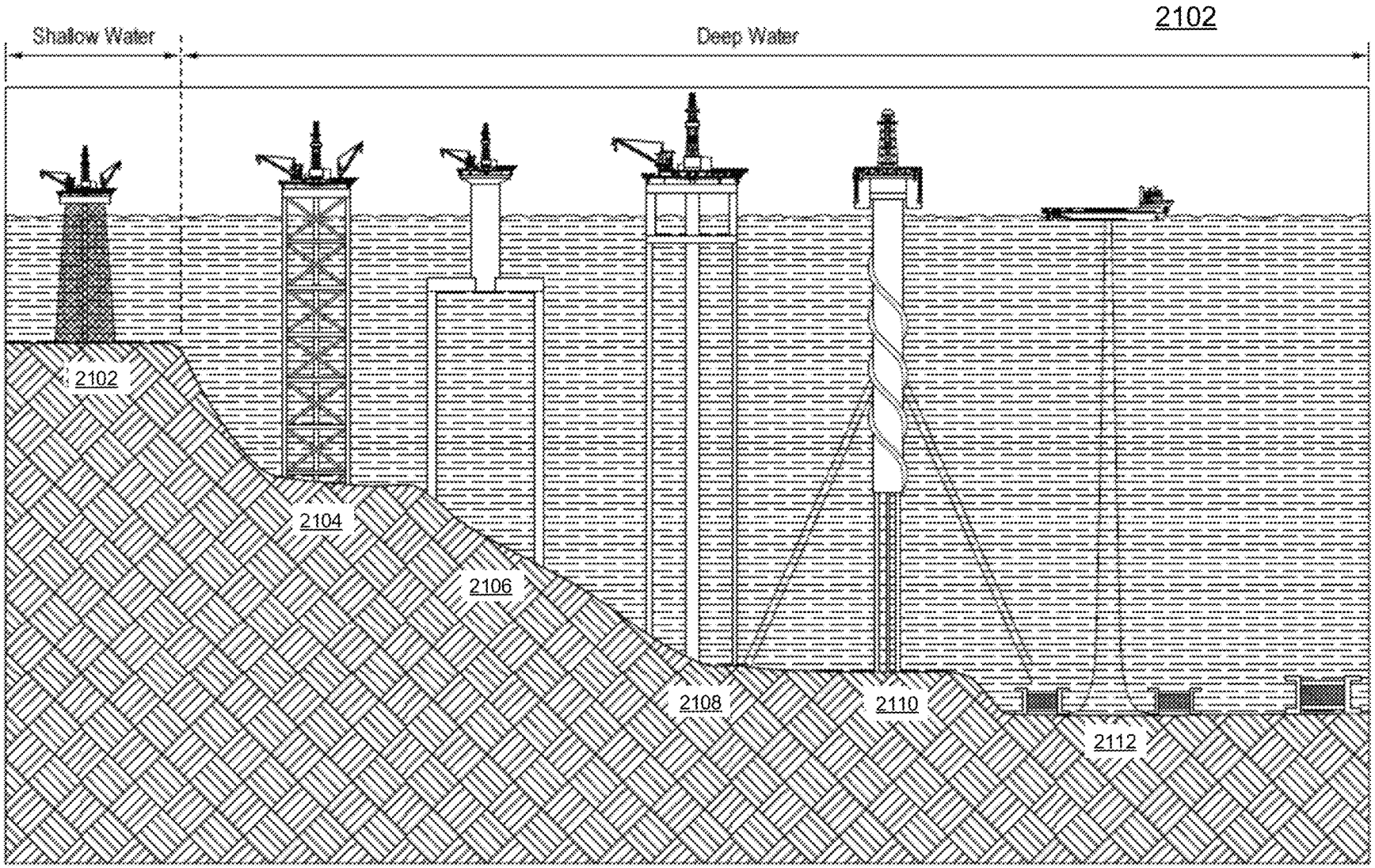
FIG. 21 is a perspective view of types of offshore well that may benefit from example implementations, according to some implementations.

FIG. 21 is a perspective view of types of offshore well that may benefit from example implementations, according to some implementations. The lifting cost of producing formation water from 3000 meters (m) is very costly. The cost of lifting solids in a high-velocity rate is extremely erosive and costly. Separating out the solids and then lifting them at a slower rate will decrease the amount erosion. FIG. 21 depicts a number of offshore wells at different depths. In particular, FIG. 21 depicts a fixed platform well 2102 (that may be used up to 200 m), a compliant piled tower well 2104 (that may be used between 200-500 m), a tension leg platform (TLP) well 2106 (that may be used between 300-1500 m), a semi floating production system (FPS) well 2108 (that may be used between 300-2000 m), a single point anchor reservoir (SPAR) platform well 2110 (that may be used between 300-2000 m), and a floating production systems-FPSO and subsea well 2112 (that may be used up to 3000 m).

Figure 22:
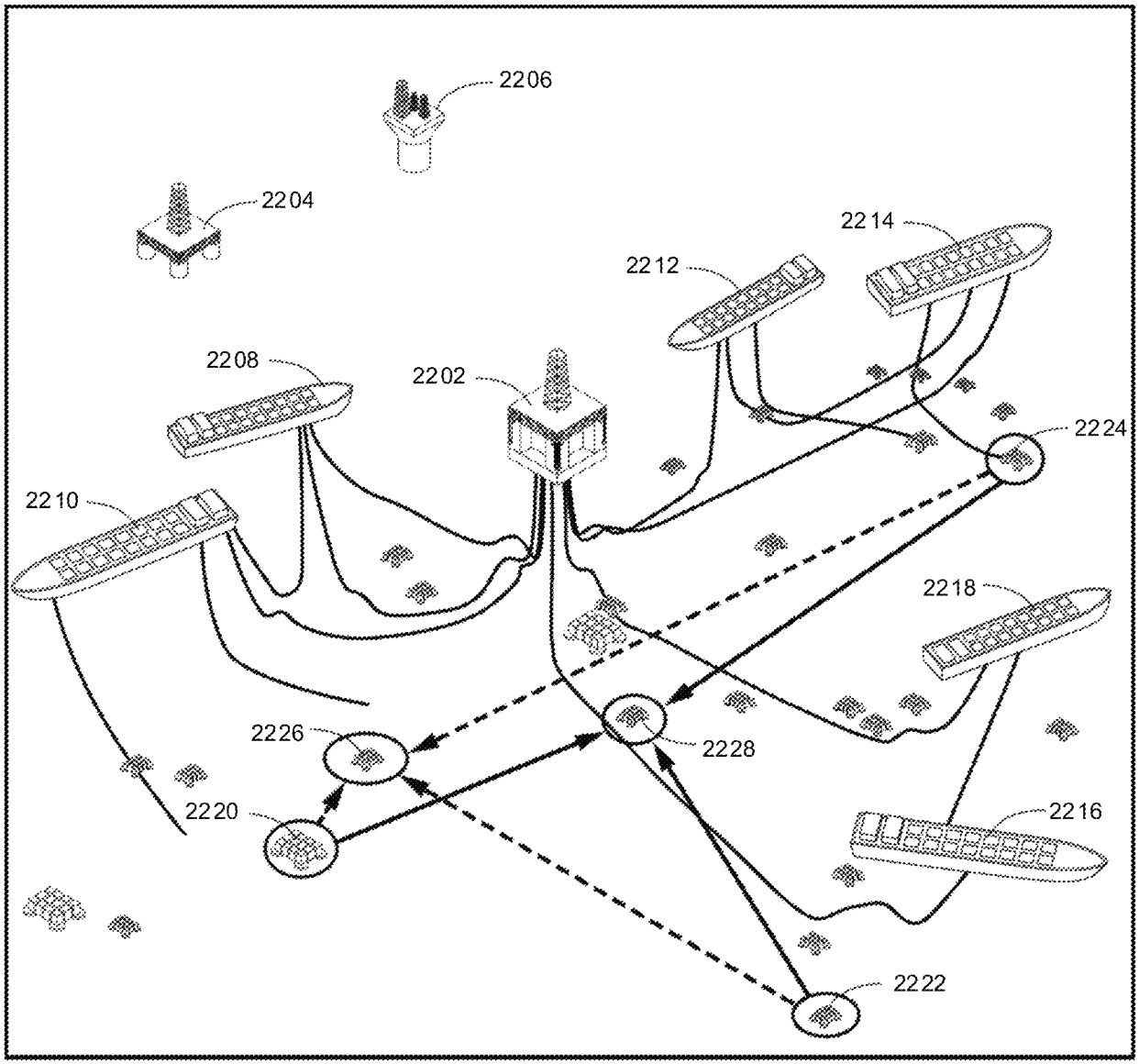
FIG. 22 is a perspective view of an example subsea downhole oil water solids separation, according to some implementations.

FIG. 22 is a perspective view of an example subsea downhole oil water solids separation, according to some implementations. FIG. 22 depicts a number of offshore rigs—an offshore rig 2202, an offshore rig 2204, and an offshore rig 2206. FIG. 22 also depicts a number of ships—a ship 2208, a ship 2210, a ship 2212, a ship 2214, a ship 2216, and a ship 2218. The offshore rigs 2202-2206 and the ships 2208-2218 may include equipment to separate out nonproduction fluid (such as water) from the production fluid. The offshore rigs 2202-2206 and the ships 2208-2218 may also include storage for the production fluid, the nonproduction fluid, etc.

FIG. 22 also depicts a number of production wells-a production well 2220, a production well 2222, and a production well 2224. FIG. 22 also depicts a water disposal well 2226 and a solids disposal well 2228. The fluids/solids from the production wells 2220-2224 may be transported to any of the oil rigs 2202-2206, any of the ships 2208-2218 or another subsurface well. For example, the nonproduction fluid and the solids from the production wells 2220-2224 may be transported to the water disposal well 2226 and the solids disposal well 2228, respectively. Additionally, production fluid processing and separation, nonproduction fluid processing and/or solids processing may occur at one of more of the locations identified in FIG. 22.

Figure 23:
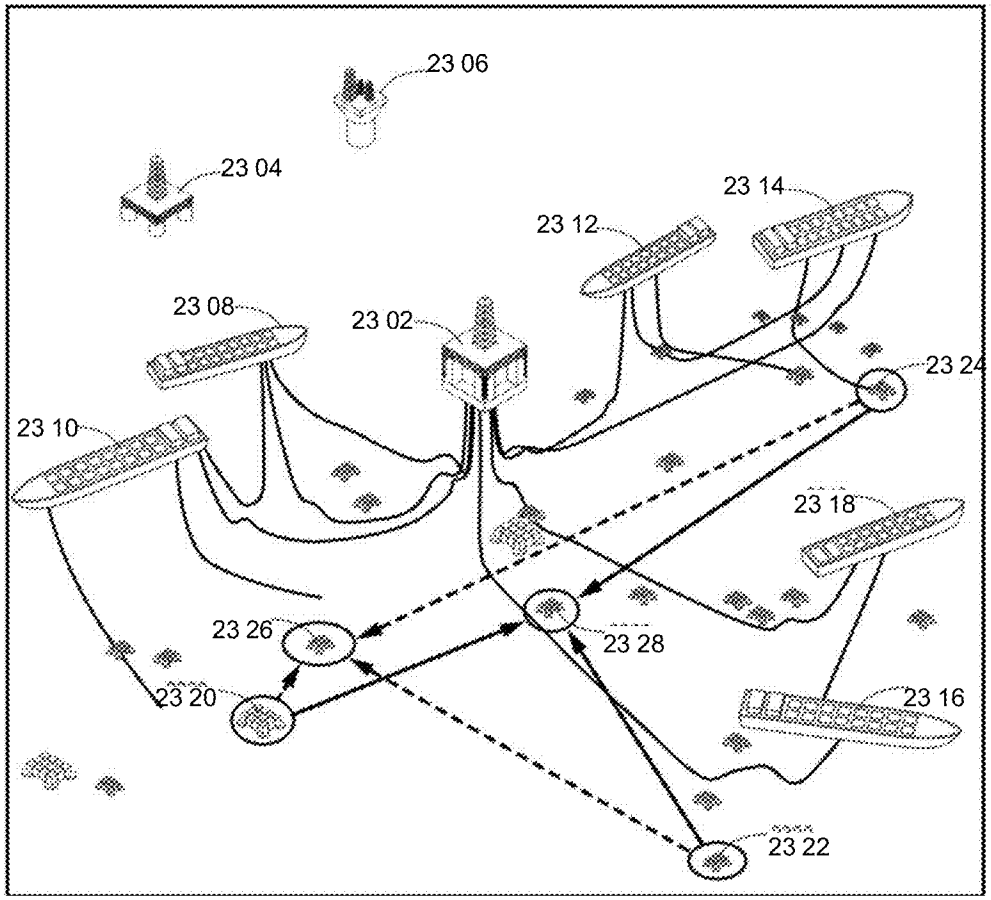
FIG. 23 is a perspective view of example locations in which example implementations may be used.

FIG. 23 is a perspective view of example locations in which example implementations may be used. FIG. 23 includes 11 example locations. A first example location includes a well 2302 where fluids may exit the well or are injected therein. A second example location includes an oil-cut processing unit 2304. For example, a flow diverter may divert oil-cut fluid to an oil-cut processing unit 2304. The oil-cut processing unit 2304 may include a flow diverter to remove more water from an oil-cut fluid. In some implementations, a flow diverter may divert solids, slurry, sludge, etc. to a solids processing unit 2306. Such solids, slurry, sludge, etc. may then be stored in a storage container or disposal well 2310. Flow diverter may be part of the storage container or disposal well 2310 to remove more oil from the slurry. The solids processing unit 2306 may include a flow diverter to remove more oil from the slurry.

FIG. 23 also depicts a number of offshore rigs—an offshore rig 2372, an offshore rig 2374, and an offshore rig 2376. FIG. 23 also depicts a number of ships—a ship 2378, a ship 2380, a ship 2382, a ship 2384, a ship 2386, and a ship 2388. The offshore rigs 2372-2376 and the ships 2378-2388 may include equipment to separate out nonproduction fluid (such as water) from the production fluid. The offshore rigs 2372-2376 and the ships 2378-2388 may also include storage for the production fluid, the nonproduction fluid, etc.

Another example location may include an oil storage and transfer unit 2308. Another example location may include a solids or slurry transfer line 2312. For example, a flow diverter may help mix, remix, stir, or agitate solids to keep them in suspension in the solids or slurry transfer line 2312. Another example location may include a production fluids/oil-cut fluid/fluid transfer line 2314. For example, a flow diverter may help mix, remix, stir, or agitate solids and the fluids to keep them flowing properly in the production fluids/oil-cut fluid/fluid transfer line 2314. Another example location may include a well 2316 with vertical, inclined, sloped, deviated, tortuous paths.

Another example location may include a multilateral well 2318 (that includes a lateral wellbore, junction, etc. Another example location may include a horizontal well 2320. Another example location may include a main production transfer line 2322 to another subsea pumping, gathering, and/or processing station or to land-based pumping, gathering, and/or processing facility.

Unless otherwise specified, use of the terms "up," "upper," "upward," "uphole," "upstream," or other like terms shall be construed as generally away from the bottom, terminal end of a well; likewise, use of the terms "down," "lower," "downward," "downhole," or other like terms shall be construed as generally toward the bottom, terminal end of the well, regardless of the wellbore orientation. Use of any one or more of the foregoing terms shall not be construed as denoting positions along a perfectly vertical axis. In some instances, a part near the end of the well can be horizontal or even slightly directed upwards. Unless otherwise specified, use of the term "subterranean formation" shall be construed as encompassing both areas below exposed earth and areas below earth covered by water such as ocean or fresh water.

Unless otherwise specified, the phrase cyclonic solids separator, hydrocyclone, hydrocyclone system, desander, desilter, centrifuge, helical separator, or other separating devices that use gravity or artificial gravity shall be construed as a device positioned downhole to separate sediment from a fluid.

It should be noted that the DOWS system and components noted above may be inclusive of all items from the wellhead to the toe of each wellbore. The cables/energy conduits that provide power to the one or more ESPs and/or other pumps and prime movers (downhole and on surface) are inclusive. The surface components that transport the fluids and solids out of the well are included. Subsea trees, subsea DOWS equipment, platform, land-base, jack up, drillship, etc. types of equipment are inclusive. All data lines, data processing, sensors, in the well and outside of the well are inclusive. All fluid processing equipment and processes in the well and outside of the well are inclusive. All solids processing equipment and processes in the well and outside of the well are inclusive. All decision-making, monitoring, and control of process(es) including human, computer, software, logical hardware and/or software, on-rig, remotely, in the cloud, on the edge, downhole, AI-related, Deep Learning, Neural Network, Machine Learning, Fuzzy Logic, etc. may be inclusive.

Other Example Separators

In addition to hydrocyclones and helical separators, other types of separators may be used with example implementations.

For example, one or more centrifuges may be added to the system, integrated into one or more devices of the systems, and/or the concept of a centrifuge may be utilized. A key difference between a centrifuge and a hydrocyclone is that hydrocyclones may function as passive separator packages capable of applying modest amounts of centrifugal force, whereas centrifuges are dynamic separators that are generally able to apply much more centrifugal force than hydrocyclones.

In some implementations, clarifiers may be used. Clarifiers are settling tanks built with mechanical means for continuous removal of solids being deposited by sedimentation. A clarifier is generally used to remove solid particulates or suspended solids from liquid for clarification and/or thickening. In some implementations, one or more clarifiers may be positioned in one or more laterals. The laterals may provide a large area for the clarifiers to function. In some implementations, a clarifier may be located subsea. In some implementations, a clarifier may be located in a shallow well drilled into the sea floor. The clarifier may be located near the well or a distance from the well. For example, it may be beneficial for the clarifier to be located near a water injection or water disposal plant and facility located one km or more from the production well.

Various implementations of a clarifier may be used including inclined plate clarifiers which may provide a large effective settling area for a small footprint. The inlet stream is stilled upon entry into the clarifier. Solid particles begin to settle on the plates and begin to accumulate in collection hoppers at the bottom of the clarifier unit. The sludge is drawn off at the bottom of these hoppers and the clarified liquid exits the unit at the top by weir.

It should be understood that the word "solids" also implies concentrated impurities and may be known as sludge, while the particles that float to the surface of the liquid are called scum.

Conveyor belts may be used for removal and transport of accumulated solids. Scrapers may be used for removal and transport of accumulated solids. Coalescing plates may be used for removing oil droplets from flowing water and/or removing solid particles from a fluid. Baffles may be used to reduce water inlet and outlet velocities to minimize turbulence and promote effective settling throughout available tank volume. Weirs (such as overflow weirs) may be used to uniformly distribute flow from liquid leaving the tank over a wide area of the surface to minimize resuspension of settling particles.

Tube or plate settlers are commonly used in rectangular clarifiers to increase the settling capacity by reducing the vertical distance a suspended particle must travel. Tube settlers are available in many different designs such as parallel plates, chevron shaped, diamond, octagon or triangle shape, and circular shape. High efficiency tube settlers may use a stack of parallel tubes, rectangles or flat corrugated plates separated by a few inches (several centimeters) and sloping upwards in the direction of flow. This structure creates a large number of narrow parallel flow pathways encouraging uniform laminar flow as modeled by Stokes' law. These structures may work in two ways. First, they provide an exceptionally large surface area onto which particles may fall and become stabilized. Second, because flow is temporarily accelerated between the plates and then immediately slows down, this helps to aggregate very fine particles that can settle as the flow exits the plates.

Structures inclined between approximately 45° and 60° may allow gravity drainage of accumulated solids, but shallower angles of inclination may typically require periodic draining and cleaning. Tube settlers may allow the use of a smaller clarifier and may enable finer particles to be separated with residence times less than 10 minutes. Typically, such structures are used for difficult-to-treat waters, especially those containing colloidal materials.

Tube settlers may capture the fine particles allowing the larger particles to travel to the bottom of the clarifier in a more uniform way. The fine particles then build up into a larger mass which then slides down the tube channels. The reduction in solids present in the outflow allows a reduction in the clarifier footprint when designing. Tubes made of PVC plastic may be a minor cost in clarifier design improvements and may lead to an increase of operating rate, such as up to 2 to 4 times.

Another advantage of separating solids upstream (further downhole) is to prevent erosional wear on other DOWS-related equipment (other separators, pumps (ESP, PCP, etc.).

Example Lithium And Other Metal Recovery Operations

Example implementations may also be used in other operations requiring the separation of fluids, solids, gases, minerals, metals, etc. In particular any operations where the work is in an uninhabitable environment and/or remote location where separation, transportation, disposal and/or processing of one or more materials is required.

For example, example implementations may be used in lithium solution mining, borate mining, etc. For example, after dissolving an ore, a saturated borate solution may be pumped into a large settling tank. Borates float on top of the liquor while rock and clay settle to the bottom.

The separation of abrasive particles may accelerate abrasion in cyclones and other separator equipment. For example, the coarse discharge of a hydrocyclone typically will experience more rapid wear than other parts of the cyclone. The use of certain materials (stainless steel, ceramics, tungsten carbide, etc.) may reduce corrosive reactions from occurring.

Use of the phrase "at least one of" preceding a list with the conjunction "and" should not be treated as an exclusive list and should not be construed as a list of categories with one item from each category, unless specifically stated otherwise. A clause that recites "at least one of A, B, and C" can be infringed with only one of the listed items, multiple of the listed items, and one or more of the items in the list and another item not listed. As used herein, the term "or" is inclusive unless otherwise explicitly noted. Thus, the phrase "at least one of A, B, or C" is satisfied by any element from the set {A, B, C} or any combination thereof, including multiples of any element.

Example Clauses

Example implementations are now described by the following clauses.

Clause 1: A downhole oil-water separation (DOWS) assembly configured to be positioned downhole in a well, the DOWS assembly comprising: a DOWS device configured to operate on fluids in the DOWS assembly; and a controller configured to determine an orientation of the DOWS device and to cause a change to the orientation of the DOWS device.

Clause 2: The DOWS assembly of clause 1 further comprising one or more sensors communicatively coupled with the controller and configured to provide orientation information to the controller.

Clause 3: The DOWS assembly of any one or more of clauses 1-2, wherein the orientation information includes an indication of a direction of gravity.

Clause 4: The DOWS assembly of any one or more of clauses 1-3, wherein.

Clause 5: The DOWS assembly of any one or more of clauses 1-4, wherein the change to the orientation of the DOWS device is in relation to the direction of gravity.

Clause 6: The DOWS assembly of any one or more of clauses 1-5, wherein the change to the orientation of the DOWS device changes pitch and/or roll of the DOWSS device.

Clause 7: The DOWS assembly of any one or more of clauses 1-6 the DOWS device comprising at least one of a sediment separator, a solids remover, and a coalescer.

Clause 8: The DOWS assembly of any one or more of clauses 1-7 further including a DOWS device configured to remove material from a tubular of the well, wherein the controller is further configured to determine the orientation of the DOWS device configured to remove material from the tubular.

Clause 9: The DOWS assembly of any one or more of clauses 1-8, wherein the well is part of a multilateral well system.

Clause 10: A method comprising: inserting a downhole oil-water-solids separation (DOWSS) assembly into a borehole of a well, the DOWSS assembly including a DOWSS device configured to operate on fluids and/or solids in the DOWSS assembly; determining, via one or more sensors and a controller, an orientation of the DOWS device; and changing, via an actuator, the orientation of the DOWS device.

Clause 11: The method of clause 10, wherein the DOWS device separates more solids from the fluids after changing an orientation.

Clause 12: The method of any one or more of clauses 10-11, wherein the change to the orientation includes a change to a pitch and/or a roll of the DOWS device Clause 13: The method of any one or more of clauses 10-12, wherein one or more sensors are communicatively coupled with the controller, and wherein the one or more sensors provide information to the controller.

Clause 14: The method of any one or more of clauses 10-13, wherein the orientation information includes an indication of the direction of gravity.

Clause 15: The method of any one or more of clauses 10-14, wherein the actuator changes the orientation of the DOWS device in relation to gravity.

Clause 16: The method of any one or more of clauses 10-15, wherein the DOWS device comprising at least one of a sediment separator, a solids remover, a coalescer.

Clause 17: The method of any one or more of clauses 10-16 further including: determining, via the controller, an orientation of a DOWS device configured to remove part of a casing of the multilateral well.

Clause 18: A monitoring and control system configured for operation in a DOWS system of a well, the monitoring and control system comprising: one or more sensors configured to be coupled with a DOWS device disposed downhole in the well and to determine information for a DOWS device; and a controller configured to determine a state of the DOWS device based on the information and to cause a change to the orientation of the DOWS device.

Clause 19: The monitoring and control system of clause 18 further comprising an actuator configured to change the state of the DOWS device via application of force to the DOWS device.

Clause 20: The monitoring and control system of any one or more of clauses 18-19, wherein the one or more sensors include an electronic accelerometer or a mechanical gravity device.

Clause 21: The monitoring and control system of any one or more of clauses 18-20, wherein the orientation information includes an indication of the direction of gravity.

Clause 22: The monitoring and control system of any one or more of clauses 18-21, 18 wherein the change to the orientation of the DOWS device is in relation to gravity.

Clause 23: The monitoring and control system of any one or more of clauses 18-22, wherein the DOWS device comprising at least one of an electrical submersible pump, a sediment separator, a solids remover, a coalescer, and a cutting tool.

The invention claimed is:

1. A downhole oil-water separation (DOWS) assembly configured to be disposed downhole in a well, the DOWS assembly comprising:

a DOWS device located within the DOWS assembly, the DOWS device configured to operate on fluids within the DOWS assembly; and a controller configured to determine an orientation of the DOWS device and to cause a change to the orientation of the DOWS device with respect to an orientation of the DOWS assembly.

2. The DOWS assembly of claim 1 further comprising:

an actuator configured to change the orientation of the DOWS device via application of force to the DOWS device.

3. The DOWS assembly of claim 1 further comprising:

one or more sensors communicatively coupled with the controller and configured to provide orientation information to the controller.

4. The DOWS assembly of claim 3, wherein the orientation information includes an indication of a direction of gravity.

5. The DOWS assembly of claim 4, wherein the change to the orientation of the DOWS device is in relation to the direction of gravity.

6. The DOWS assembly of claim 4 further comprising, wherein the change to the orientation of the DOWS device changes pitch and/or roll of the DOWS device.

7. The DOWS assembly of claim 1, wherein the DOWS device comprising at least one of a sediment separator, a solids remover, and a coalescer.

8. The DOWS assembly of claim 1 further including:

a second DOWS device located within the DOWS assembly, the second DOWS device configured to remove material from a tubular of the well, wherein the controller is further configured to determine an orientation of the second DOWS device within the DOWS assembly and to cause a change to the orientation of the second DOWS device with respect to an orientation of the DOWS assembly.

9. A method comprising:

inserting a downhole oil-water-solids separation (DOWSS) assembly into a borehole of a well, the DOWSS assembly including a DOWSS device, the DOWSS device configured to operate on fluids and solids within the DOWSS assembly;

determining, via one or more sensors and a controller, an orientation of the DOWSS device within the DOWSS assembly; and changing, via an actuator, the orientation of the DOWSS device with respect to an orientation of the DOWSS assembly.

10. The method of claim 9 wherein the DOWSS device is configured to separate more solids from the fluids after changing the orientation.

11. The method of claim 10, wherein the change to the orientation includes a change to a pitch and/or a roll of the DOWSS device.

12. The method of claim 10, wherein the actuator also changes the orientation of the DOWSS device in relation to gravity.

13. The method of claim 9, wherein one or more sensors are communicatively coupled with the controller, and wherein the one or more sensors provide information to the controller.

14. The method of claim 13, wherein the information includes an indication of a direction of gravity.

15. The method of claim 9, the DOWSS device comprising at least one of a sediment separator, a solids remover, and a coalescer.

16. The method of claim 9 further including:

determining, via the controller, an orientation of a second DOWSS device within the DOWSS assembly, the second DOWSS device configured to remove part of a casing of the well.

17. A monitoring and control system configured for operation in a DOWS system of a well, the DOWS system including a DOWS device, the monitoring and control system comprising:

one or more sensors configured to be coupled with the DOWS device disposed downhole in the well and to determine information for the DOWS device; and a controller configured to determine a state of the DOWS device based on the information and to cause a change to an orientation of the DOWS device with respect to an orientation of the DOWS system based on the information.

18. The monitoring and control system of claim 17 further comprising:

an actuator configured to change a state of the DOWS device via an application of force to the DOWS device.

19. The monitoring and control system of claim 17, wherein the sensors include one or more of an electronic accelerometer and a mechanical gravity device.

20. The monitoring and control system of claim 19, wherein the information includes an indication of the direction of gravity.

21. The monitoring and control system of claim 20 wherein the change to the orientation of the DOWS device is also in relation to gravity.

22. The monitoring and control system of claim 17, the DOWS device comprising at least one of an electrical submersible pump, a sediment separator, a solids remover, a coalescer, and a cutting tool.

* * * * *